US007872612B2

(12) United States Patent
Otsuka et al.

(10) Patent No.: US 7,872,612 B2
(45) Date of Patent: Jan. 18, 2011

(54) ANTENNA APPARATUS UTILIZING APERTURE OF TRANSMISSION LINE

(75) Inventors: Kanji Otsuka, 2-1074-38, Kohan, Higashiyamato-shi, Tokyo 207-0002 (JP); Tamotsu Usami, 2-38-4, Nishi-machi, Kokubunji-shi, Tokyo 185-0035 (JP); Yutaka Akiyama, 120-12, Katakura-machi, Hachioji-shi, Tokyo 192-0914 (JP); Chihiro Ueda, 2-6-8, Higashi-ikou, Adachi-ku, Tokyo 121-0801 (JP)

(73) Assignees: Kanji Otsuka, Tokyo (JP); Tamotsu Usami, Tokyo (JP); Yutaka Akiyama, Tokyo (JP); Renesas Electronics Corporation, Tokyo (JP); Kabushiki Kaisha Toshiba, Tokyo (JP); Fujitsu Microelectronics Limited, Tokyo (JP); Fuji Xerox Co., Ltd., Tokyo (JP); Ibiden Co., Ltd, Gifu (JP); Kyocera Corporation, Kyoto (JP); Chihiro Ueda, Tokyo (JP)

( * ) Notice: Subject to any disclaimer, the term of this patent is extended or adjusted under 35 U.S.C. 154(b) by 32 days.

(21) Appl. No.: 12/155,247

(22) Filed: May 30, 2008

(65) Prior Publication Data

US 2008/0316136 A1 Dec. 25, 2008

(30) Foreign Application Priority Data

May 30, 2007 (JP) ..... 2007-143565

(51) Int. Cl.
*H01Q 9/28* (2006.01)

(52) U.S. Cl. ..... 343/807; 343/772

(58) Field of Classification Search ..... 343/850, 343/767, 786, 777, 807

See application file for complete search history.

(56) References Cited

U.S. PATENT DOCUMENTS 4,667,205 A * 5/1987 Gehin ..... 343/783

(Continued)

FOREIGN PATENT DOCUMENTS

| | | |
|---|---|---|
| GB | 2 265 759 A | 10/1993 |
| JP | 47-032713 A | 3/1972 |
| JP | 2003-224462 | 8/2003 |
| JP | 2004-007657 | 1/2004 |
| JP | 2004-254155 | 9/2004 |
| JP | 2005-051496 | 2/2005 |
| JP | 2005-244733 | 9/2005 |

OTHER PUBLICATIONS

Otsuka, K., et al., "Stacked Pair Line", Journal of Japan Institute of Electronics Packaging (JIEP), Nov. 2001, pp. 556-561, vol. 4 No. 7. (In Japanese and its English translation).

(Continued)

*Primary Examiner*—Jacob Y Choi
*Assistant Examiner*—Kyana R Robinson
(74) *Attorney, Agent, or Firm*—McDermott Will & Emery LLP

(57) ABSTRACT

An antenna apparatus utilizing an aperture of transmission line, which is connected to a first transmission line having a predetermined characteristic impedance, includes a tapered line portion, and an aperture portion. The tapered line portion is connected to one end of the transmission line, and the tapered line portion includes a second transmission line including a pair of line conductors. The tapered line portion keeps a predetermined characteristic impedance constant and expands at least one of a width of the transmission line and an interval in a tapered shape at a predetermined taper angle. The aperture portion has a radiation aperture connected to one end of the tapered line portion. A size of one side of the aperture end plane of the aperture portion is set to be equal to or higher than a quarter wavelength of the minimum operating frequency of the antenna apparatus.

10 Claims, 28 Drawing Sheets

U.S. PATENT DOCUMENTS

| | | | | |
|---|---|---|---|---|
| 4,890,118 | A * | 12/1989 | Hudspeth et al. | 343/786 |
| 5,959,591 | A * | 9/1999 | Aurand | 343/786 |
| 5,973,653 | A * | 10/1999 | Kragalott et al. | 343/786 |
| 7,113,002 | B2 | 9/2006 | Otsuka et al. | |
| 7,173,449 | B2 | 2/2007 | Otsuka et al. | |
| 7,190,188 | B2 | 3/2007 | Otsuka et al. | |
| 7,274,262 | B2 * | 9/2007 | Ham et al. | 331/99 |
| 2004/0165669 | A1 | 8/2004 | Otsuka et al. | |
| 2006/0044201 | A1 | 3/2006 | Arnold et al. | |
| 2006/0049991 | A1 * | 3/2006 | Schantz | 343/700 MS |
| 2006/0125706 | A1 * | 6/2006 | Amyotte et al. | 343/786 |
| 2007/0285314 | A1 * | 12/2007 | Mortazawi et al. | 342/375 |

OTHER PUBLICATIONS

Otsuka, K., et al., "Measurement Potential Swing by Electric Field on Package Transmission Lines", Proceedings of ICEP, Apr. 2001, pp. 490-495.

Otsuka, K., et al., "Measurement Evidence of Mirror Potential Traveling on Transmission Lines", Technical Digest of 5th VLSI Packaging Workshop of Japan, Dec. 2000, pp. 27-28.

Japanese Office Action issued in Japanese Patent Application No. JP 2007-143565 dated Sep. 7, 2010.

* cited by examiner

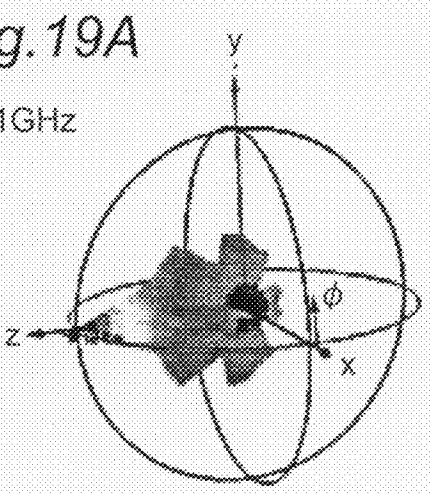
Fig.19A
1GHz
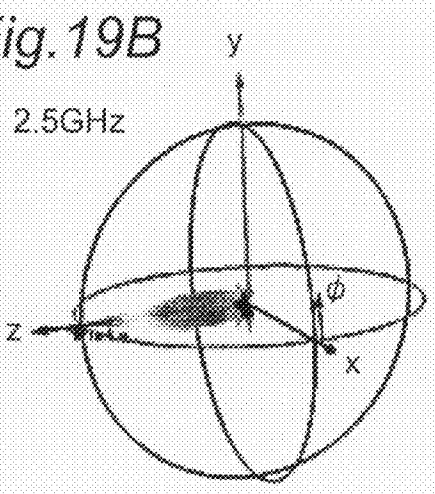
Fig.19B
2.5GHz
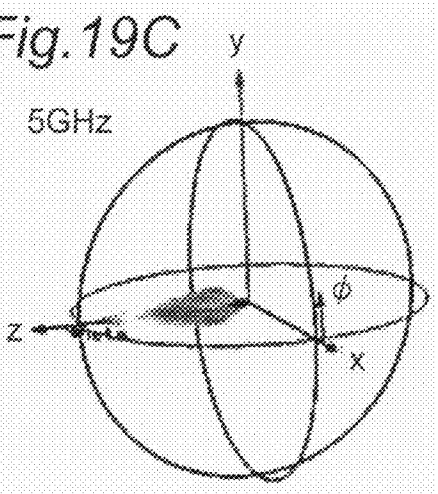
Fig.19C
5GHz
Fig.19D
7.5GHz
Fig.19E
10GHz

ANTENNA APPARATUS UTILIZING APERTURE OF TRANSMISSION LINE

BACKGROUND OF THE INVENTION

1. Field of the Invention

The present invention relates to an antenna apparatus utilizing an aperture of transmission line, and in particular, to an antenna apparatus which can be used in frequency bands such as bands of microwaves, quasi millimeter waves, millimeter waves, or the like.

2. Description of the Related Art

An antenna has been always used in wireless communication systems such as portable telephones. The concept of the conventional antenna has such a structure for resonating at a specified frequency, and a typical dipole antenna resonates at a half of an operating wavelength thereof.

In the dipole antenna, electromagnetic waves having the TM (Transverse Magnetic) mode are generated concentrically around the pole. However, electromagnetic waves that have reached a distance several times the wavelength interfere with one another at the boundary portions thereof, and the electromagnetic wave mode is transformed into TEM (Transverse Electro-Magnetic) mode (the radio waves thereof is called as transverse waves), and is radiated almost in a form of spherical waves. When the radius of curvature is increased, the electromagnetic waves become plane waves. The electromagnetic waves travel as group waves where a lots of electromagnetic waves travel so as to be distributed in a transverse straight line (namely, distributed averagely to a plane perpendicular to the traveling direction) concurrently travel. The documents which are related to the present invention are as follows:

Patent Document 1: Japanese patent laid-open publication No. JP 2005-244733 A;

Non-Patent Document 1: Kanji Otsuka, et al, "Measurement Potential Swing by Electric Field on Package Transmission Lines", Proceedings of ICEP, pp. 490-495, April 2001;

Non-Patent Document 2: Kanji Otsuka, et al, "Measurement Evidence of Mirror Potential Traveling on Transmission Lines", Technical Digest of 5th VLSI Packaging Workshop of Japan, pp. 27-28, December 2000; and Non-Patent Document 3: Kanji Otsuka et al, "Stacked pair line", Journal of Japan Institute of Electronics Packaging (JIEP), Vol. 4, No. 7, pp. 556-561, November, 2001.

Since the group waves fill up the space, the group waves need not only frequency allocation by the Radio Law but also a sufficient protection circuit against resonant mode noises leaking from the band, and the high-frequency circuit substantially becomes a circuit having a large overhead. Furthermore, the group waves are heavily attenuated even in the air at high frequencies in the bands equal to or higher than GHz band and become a level, that is larger than such an attenuation theorem at lower frequencies that the energy becomes weak in inverse proportion to the square of the distance (because of expansion in a spherical shape), and that is in inverse proportion to the cube of the distance by approximation, and this leads to that it is difficult to perform long distance communications.

SUMMARY OF THE INVENTION

An object of the present invention is to solve the above-mentioned problems and provide an antenna apparatus, that is connected to a transmission line and has a simple configuration and a directivity of almost no change in frequency characteristics, and that is capable of performing communications even at a comparatively long distance.

In order to achieve the aforementioned objective, according to one aspect of the present invention, there is provided an antenna apparatus utilizing an aperture of transmission line, and the antenna apparatus is connected to a first transmission line having a predetermined characteristic impedance. The antenna apparatus includes a tapered line portion, and an aperture portion. The tapered line portion is connected to one end of the transmission line, and the tapered line portion includes a second transmission line including a pair of line conductors. The tapered line portion keeps a predetermined characteristic impedance constant and expands at least one of a width of the transmission line and an interval in a tapered shape at a predetermined taper angle. The aperture portion has a radiation aperture connected to one end of the tapered line portion. A size of one side of the aperture end plane of the aperture portion is set to be equal to or higher than a quarter wavelength of the minimum operating frequency of the antenna apparatus.

The antenna apparatus preferably further includes a first support member that short-circuits and supports the second transmission line including the pair of line conductors substantially in a center portion in a width direction of the transmission line of the aperture portion.

In addition, the antenna apparatus preferably further includes a pair of second support members that short-circuit and support the second transmission line including the pair of line conductors substantially at both ends in a width direction of the transmission line of the aperture portion.

In the above-mentioned antenna apparatus, the aperture portion is preferably constituted by expanding a width of the transmission line in a tapered shape.

In the above-mentioned antenna apparatus, a space located between the pair of line conductors of the first transmission line in the tapered line portion is preferably filled with a predetermined dielectric.

In the above-mentioned antenna apparatus, a space located between the pair of line conductors of the second transmission line in the aperture portion is preferably filled with a predetermined dielectric.

The above-mentioned antenna apparatus preferably further includes a first support member for supporting both end portions in a width direction of the transmission line of the first transmission line in the tapered line portion with interposition of a predetermined interval.

The above-mentioned antenna apparatus preferably further includes a second support member for supporting both end portions in the width direction of the transmission line of the second transmission line in the aperture portion with interposition of a predetermined interval.

In the above-mentioned antenna apparatus, the taper angle is preferably set to a predetermined value which is larger than zero degree and equal to or smaller than 30 degrees.

In the above-mentioned antenna apparatus, the characteristic impedance is preferably set to a predetermined value that is set within a range from 50Ω to 100 Ω.

Accordingly, the antenna apparatus utilizing the aperture of transmission line according to the present invention is connected to the transmission line, and has a configuration much simpler than that of the prior art and a narrow directivity with almost no change in frequency characteristics, thereby making it possible to achieve a large antenna gain and to perform communications even at a comparatively long distance.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 19A is a graph showing a directional pattern at 1 GHz of the antenna apparatus utilizing the aperture of transmission line used in the simulations of the present preferred embodiment;

FIG. 19B is a graph showing a directional pattern at 2.5 GHz of the antenna apparatus utilizing the aperture of transmission line used in the simulations of the present preferred embodiment;

FIG. 19C is a graph showing a directional pattern at 5 GHz of the antenna apparatus utilizing the aperture of transmission line used in the simulations of the present preferred embodiment;

FIG. 19D is a graph showing a directional pattern at 7.5 GHz of the antenna apparatus utilizing the aperture of transmission line used in the simulations of the present preferred embodiment;

FIG. 19E is a graph showing a directional pattern at 10 GHz of the antenna apparatus utilizing the aperture of transmission line used in the simulations of the present preferred embodiment;

DETAILED DESCRIPTION OF THE PREFERRED EMBODIMENTS

Figure 1:
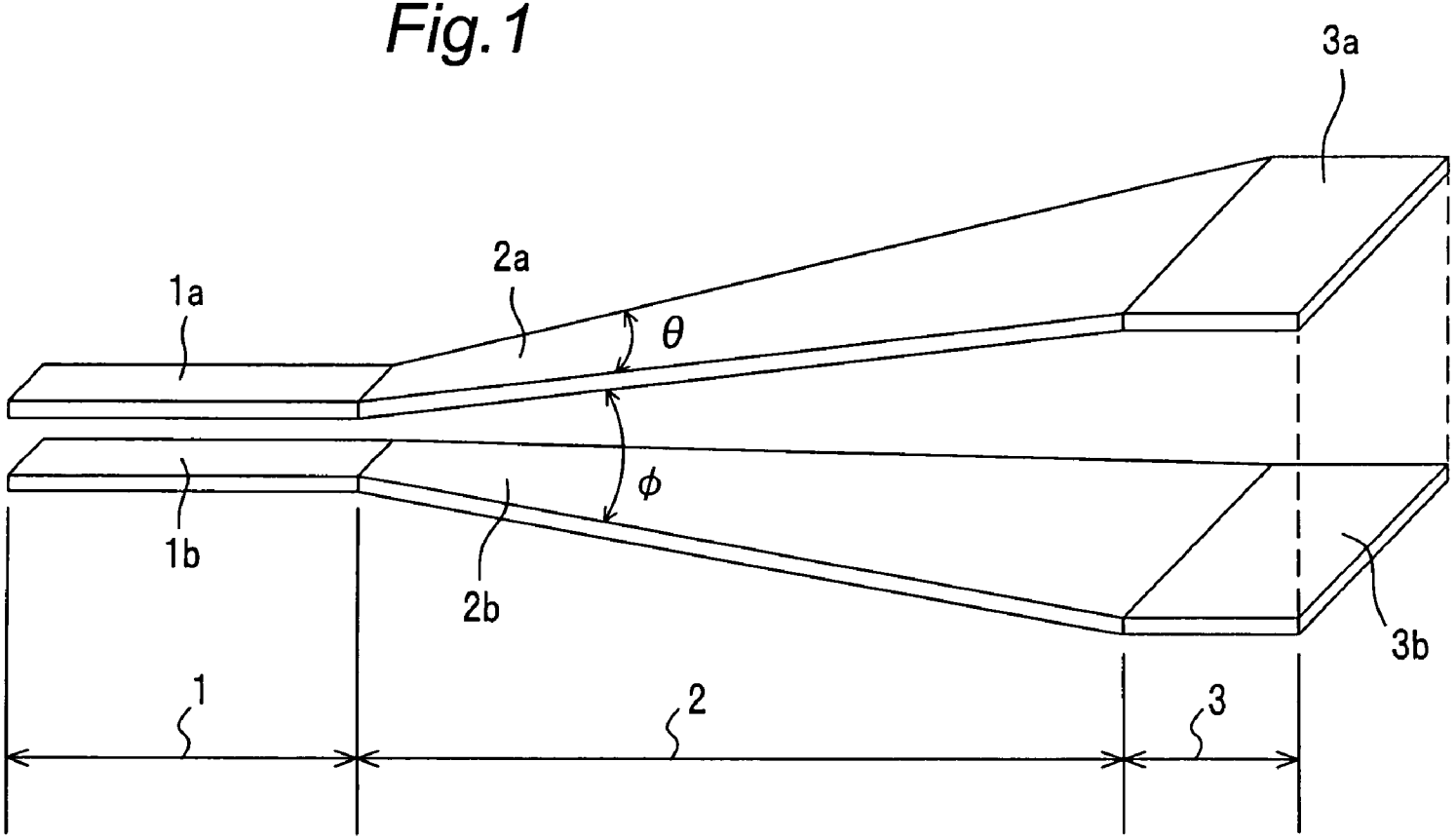
FIG. 1 is a perspective view showing an appearance of an antenna apparatus utilizing an aperture of transmission line according to a first preferred embodiment of the present invention.

Preferred embodiments of the present invention will be described below with reference to the drawings. In each of the following preferred embodiments, like components are denoted by like reference numerals.

The present invention is derived from a fundamental principle quite different from that of the antenna that resonates at a specified frequency such as a dipole antenna, and has a theoretically novel configuration as described in detail below.

FIG. 1 is a perspective view showing an appearance of the antenna apparatus utilizing the aperture of transmission line according to the first preferred embodiment of the present invention. The antenna apparatus utilizing the aperture of transmission line of the first preferred embodiment is connected to a stacked pair line 1 including a pair of line conductors 1*a* and 1*b* each having a predetermined characteristic impedance such as 50Ω, where a pair of line conductors 1*a* and 1*b* oppose to each other.

The antenna apparatus of the present preferred embodiment is characterized by including the following:

(A) a tapered line portion 2, which is connected to one end of the stacked pair line 1 and includes a transmission line including a pair of planar line conductors 2*a* and 2*b* opposing to each other, where both (this may be at least one) of a width of the transmission line and an interval between the line conductors 2*a* and 2*b* (referred to as an antenna interval hereinafter) are expanded in a tapered shape at predetermined taper angles θ and Φ with a predetermined characteristic impedance maintained or kept to be constant; and (B) an aperture portion 3 having a radiation aperture connected to one end of the tapered line portion 2, and including a pair of parallel planar line conductors 3*a* and 3*b* opposing to each other, and (C) where the size of one side of the aperture end plane of the aperture portion 3 is set to equal to or higher than the quarter wavelength of the minimum operating frequency.

The configuration and operation of the antenna apparatus utilizing the aperture of transmission line of the present preferred embodiment will be described below.

The electromagnetic waves that travel in the structure of the transmission line are confined in the structure in the traveling direction with respect to group waves, and therefore, enter the state of one line of electromagnetic waves limited by the structure. When only an electromagnetic wave having a certain frequency travels, the electromagnetic wave is also aligned in phase. If the electromagnetic wave is radiated to the space, a line of electromagnetic waves (whose frequency is lower than that of light) similar to a beam of laser light is formed. The present invention was derived from this conceptual origin. The frequency of the electromagnetic wave is, of course, lower than that of light, and it is impossible to keep a non-dispersed state unlike a beam of laser light, and the electromagnetic wave finally becomes TEM wave. However, the dispersion is suppressed at a short distance, and the square term of the distance can be ignored. Within this interval, the effect obtained by only the influence of attenuation, i.e., the square of the distance is effected, and the electromagnetic wave reaches a far destination point with weaker energy. If the distance is relatively short, the transmitting direction can be specified if the receiving location and the azimuth are determined in a manner similar to that of the case of a pencil of light, and the radio waves do not leak in azimuths other than those of transmitting and receiving. Therefore, not only applications different from those according to the conventional Radio Law can be considered, but also clean waves can be obtained since the spatial noise level (ground level) is not raised. So to speak, this results in the concept equivalent to providing conductor wiring of an electronic circuit in the air. Further, only TEM waves are in far locations, and able to be handled similar to the conventional antenna, whereas this results in a configuration in which the waves can effectively reach far locations by the distance of the convergent part in near locations.

The above description has been made on the assumption that the electromagnetic waves in the electromagnetic state of the transmission line are emitted to the space, and it becomes possible by making the transmission line abruptly or suddenly has an aperture portion in a manner similar to that of the stub wiring. This is the phenomenon conventionally known as stub noise radiation. The present invention provides an antenna that positively utilizes the phenomenon and takes its efficiency into consideration.

The structures shown in FIGS. 11 to 14 can be considered as the transmission line. Although the transmission lines, each including two pairs of lines, are shown in the present cases, the fundamental structure may be a pair of lines. These are, of course, well known in the art. A planar pair line (FIG. 13), a coplanar line (FIG. 14), a stacked pair line (FIG. 11), a split strip line (FIG. 12) and so on can be considered. It has been well known as a common sense that these transmission lines have no frequency characteristic.

The principle of the present invention is simply shown below. First of all, assuming that an inductance per unit length of the line is $L_0$ [H/m], a capacitance per unit length is $C_0$ [F/m], a resistance per unit length is $R_0$ [Ω/m], and a leakage conductance per unit length is $G_0$ [S/m], then the characteristic impedance $Z_0$ [Ω] of the transmission line having a predetermined length is expressed by the following Equation (1):

$$Z_0 = \sqrt{\frac{R_0 + j\omega L_0}{G_0 + j\omega C_0}}. \tag{1}$$

Assuming that the line is enough short and the resistance $R_0$ and the leakage conductance $G_0$ can be ignored, then $R_0=G_0=0$, and the Equation (1) is expressed by the following Equation (2):

$$Z_0 = \sqrt{\frac{j\omega L_0}{j\omega C_0}} = \sqrt{\frac{L_0}{C_0}} = \sqrt{\frac{L}{C}}. \tag{2}$$

The frequency dependence and length dependence are removed, and this is equivalent to the parameter of the total line length. That is, the defined characteristic impedance is identical even if the transmission line is short or extremely long. This is expressed metaphorically as the reciprocal of a conductance corresponding to the cross section area of a water pipe. It can be expressed by the physical concept of the reciprocal of the conductance of every section of the transmission line. Therefore, it can be expressed by a dimensional structure of the section which the electromagnetic waves can pass through. That is, it is expressed by the following Equation (3):

$$Z_0 = \sqrt{\frac{L_0}{C_0}} = \frac{1}{K}\sqrt{\frac{\mu_r\mu_0}{\varepsilon_r\varepsilon_0}}\left(\frac{d}{w}\right) = 377\frac{1}{K}\sqrt{\frac{\mu_r}{\varepsilon_r}}\left(\frac{d}{w}\right). \tag{3}$$

Figure 8:
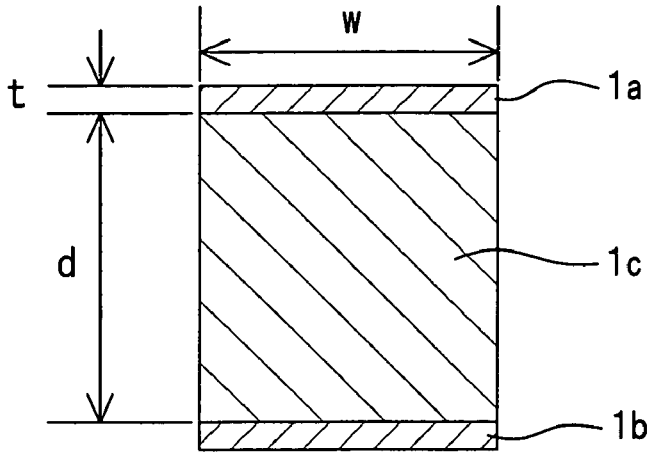
FIG. 8 is a longitudinal sectional view showing a structure of a stacked pair line used in the present preferred embodiment.

For example, the structure and the parameters of the transmission line are shown in FIG. 8 such as the stacked pair line. A fringe coefficient K shown in the following Table 1 is the ratio of an electromagnetic energy (numerator) in a material (this may be, for example, air or a dielectric 1*c* having a specific inductive capacity $\in_r$ and a relative magnetic permeability $\mu_r$) having a width "w" of the transmission line and an interval (or aperture size) "d" interposed between a pair of line conductors 1*a* and 1*b* of FIG. 8 to the total electromagnetic energy (denominator) including energies distributed outside the same line.

TABLE 1

| Fringe Coefficient K | | |
|---|---|---|
| w/d | $\epsilon_r = 1, \mu_r = 1$ | $\epsilon_r = 4.5, \mu_r = 1$ |
| 0.100 | 14.33 | 9.30 |
| 0.125 | 12.08 | 7.90 |
| 0.200 | 8.51 | 5.68 |
| 0.250 | 7.25 | 4.86 |
| 0.500 | 4.25 | 3.14 |
| 1.000 | 2.98 | 2.17 |
| 2.500 | 1.92 | 1.50 |
| 5.000 | 1.52 | 1.27 |
| 10.00 | 1.29 | 1.14 |

Figure 9:
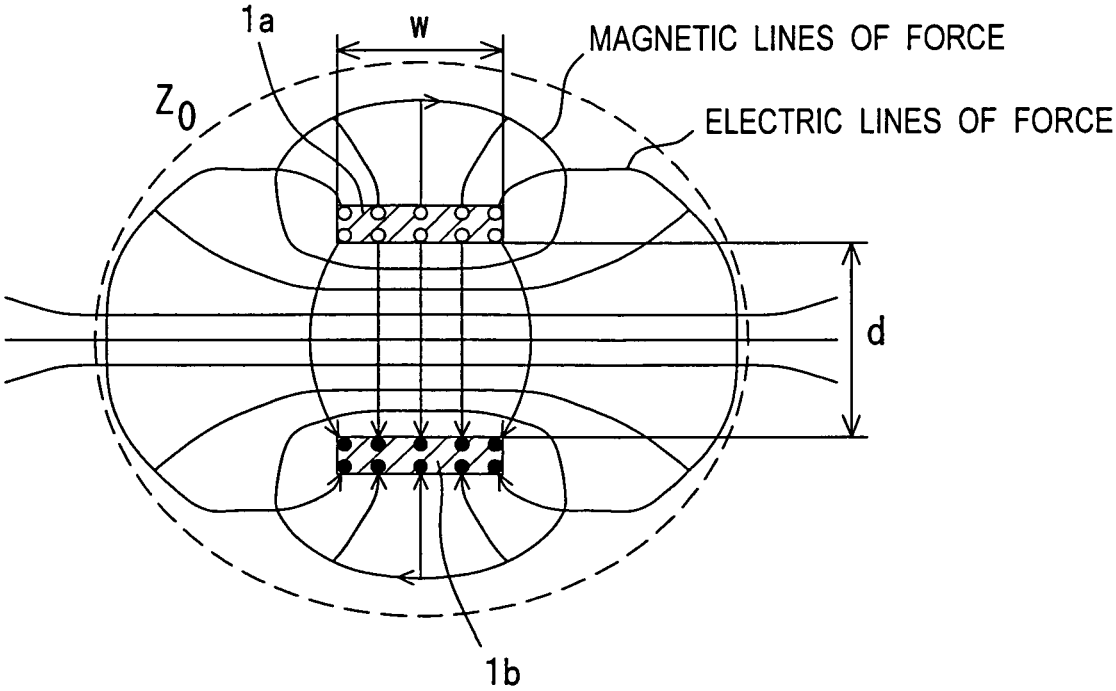
FIG. 9 is a longitudinal sectional view showing a distribution of electromagnetic lines of force between a pair of line conductors of the stacked pair line of FIG. 8 on a plane parallel to the width direction of the transmission line.
Figure 10:
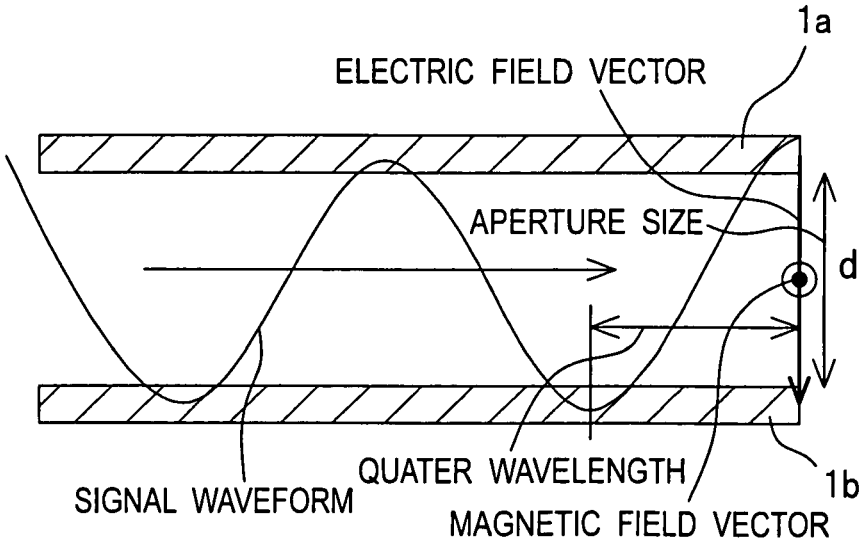
FIG. 10 is a longitudinal sectional view showing a distribution of the electromagnetic lines of force between a pair of line conductors of the stacked pair line of FIG. 8 on a plane parallel to the longitudinal direction of the transmission line.
Figure 11:
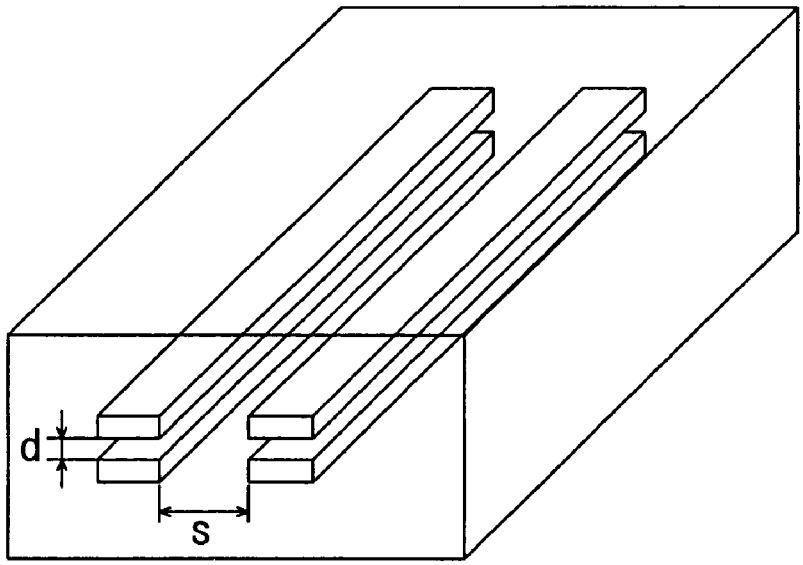
Fig.11 PRIOR ART
FIG. 11 is perspective view showing a structure of a stacked pair line according to a prior art.
Figure 12:
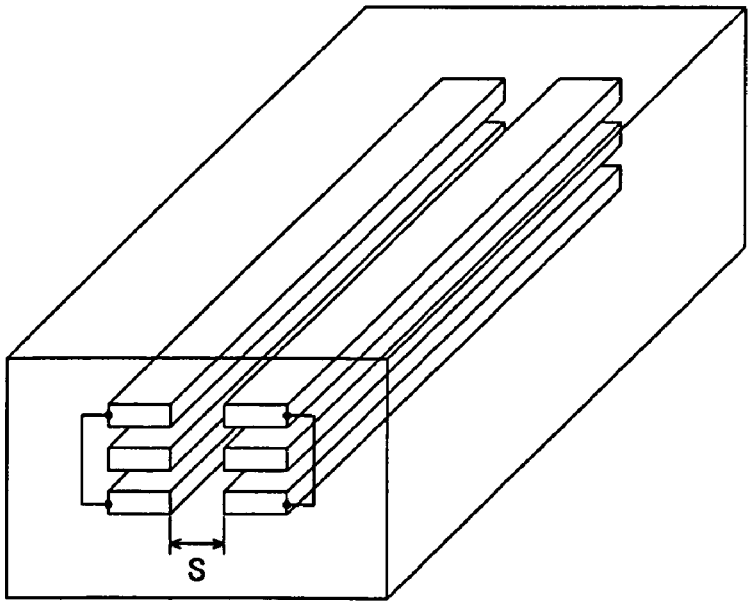
Fig.12 PRIOR ART
FIG. 12 is a perspective view showing a structure of a split strip line (top and bottom commonly grounded) according to a prior art.
Figure 13:
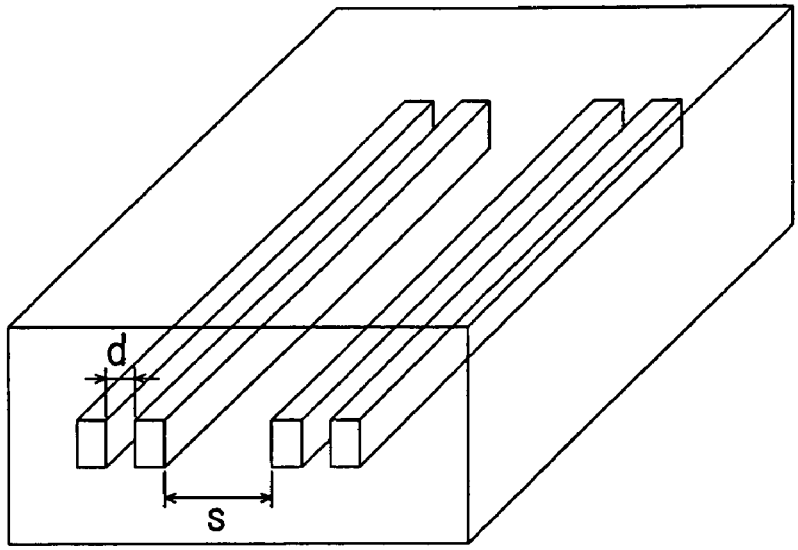
Fig.13 PRIOR ART
FIG. 13 is a perspective view showing a structure of a planar pair line according to a prior art.
Figure 14:
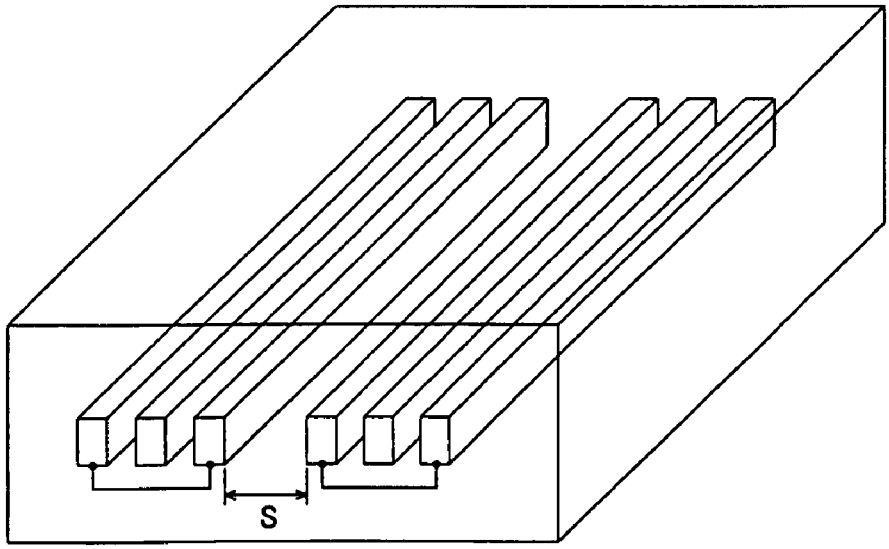
Fig.14 PRIOR ART
FIG. 14 is a perspective view showing a structure of a coplanar line (both sides commonly grounded) according to a prior art.

If the distribution of the electromagnetic field of the pair line is described a little more, the distribution becomes as shown in FIGS. 9 and 10. When there are positive charges in the top line conductor 1*a* as shown in FIG. 9, negative charges correspond to them in the bottom line conductor 1*b*. The electric lines of force are generated so as to make connections from the positive charges to the negative charges and come to have expansion so as to spatially minimize the mutual interference. Although the electric lines of force expand into the infinite space because of innumerable numbers of electric charges existing in the conductor, it is preferable to handle only the space that cannot be ignored by approximation. When the electric charges move in the depth direction of the sheet plane, the magnetic lines of force are generated surrounding the line conductors 1*a* and 1*b* and perpendicularly intersect the electric lines of force. Since the positive charges travel in the depth direction of the sheet plane, the magnetic fields are clockwise in the upper half and counterclockwise in the lower half. They help each other like mutually meshing gears at the center. The elements operate as negative mutual inductances $M_{12}$ and $M_{21}$ that cancel the self-inductances $L_1$ and $L_2$ of the conductors. In this case, the effective inductance $L_0$ per unit length is expressed by the following Equation (4):

$$L_0 = L_1 + L_2 - M_{12} - M_{21} = \left(\frac{\mu_0\mu_r}{K}\right)\frac{d}{w}. \tag{4}$$

As the interval between the top and bottom line conductors 1*a* and 1*b* is narrowed, the mutual inductances $M_{12}$ and $M_{21}$ increase, and the effective inductance $L_0$ per unit length decreases. On the other hand, as the top and bottom line conductors 1*a* and 1*b* become closer to each other, the electric lines of force are reduced in length, and the coupling is intensified, consequently increasing the capacitance per unit length. That is, it is expressed by the following Equation (5):

$$C_0 = \varepsilon_0\varepsilon_r K\frac{w}{d}. \tag{5}$$

As a result, as the line conductors 1*a* and 1*b* come closer to each other, the characteristic impedance is reduced as indicated by the Equation (3).

FIG. 10 shows a distribution of the electromagnetic lines of force on the stacked pair line when seen in the traveling direction. The signal has the maximum amplitude so that the state of FIG. 9 is established when the right-end plane is regarded as the aperture portion, and the electromagnetic vector is perpendicular to the sheet plane as illustrated. The interval d of the aperture and the quarter wavelength (accurately ¼ of the guide wavelength λg of the transmission line) of the signal frequency are illustrated by same dimensions. The present inventor and others discovered that time corresponding to the time of vector change was the time of passing through the interval "d", and the electromagnetic radiation could efficiently be achieved with the dimensions. The present inventor further discovered that only required was (¼)λg≦d, and the frequencies having (¼)λg shorter than the interval "d" were all efficiently radiated. In other words, it is the discovery of a directional antenna having no frequency characteristic.

As well known, in the transmission line, the electromagnetic waves cause energy reflection depending on the degree of change at the change in the characteristic impedance. When electromagnetic waves travel from a port 1 (suffix 1) to a port 2 (suffix 2), the reflectance Γ is expressed by the following Equation (6):

$$\Gamma = \frac{Z_{02} - Z_{01}}{Z_{02} + Z_{01}}. \tag{6}$$

If the transmission line has an open end, then impedance seen from charges is infinite, and therefore, the reflectance Γ=+1 in the Equation (6), which results in total reflection with no radiation of electromagnetic waves into the air. The reflection occurs when Γ=−1 at a short-circuited end, or the energy is totally consumed by the matching resistance at an impedance-matched end and emitted as thermal energy, which results in a complete failure in producing the effect of the antenna. However, it is presumed that the time space relaxation condition that satisfies the spatial radiation condition is established when (¼)λg≦d as shown in FIG. 10. An open-end transmission line structure that maintains the condition of (¼)λg≦d is the fundamental structure of the antenna apparatus utilizing the aperture of transmission line of the present invention.

The transmission line propagates a line of electromagnetic waves, which are aligned in phase in the case of a single frequency. Therefore, the radiated electromagnetic waves additionally have such an advantageous effect that they travel in a line of electromagnetic waves that hardly disperse in a manner similar to that of the case of a beam of laser light. Since the transmission line has no frequency characteristic, it becomes possible to radiate even a composite wave like a pulse without changing the composition ratio. Accordingly, an antenna structure is proposed which needs none of generally so-called high-frequency circuits such as the oscillator circuit, the frequency converter circuit in the receiver circuit.

Figure 7:
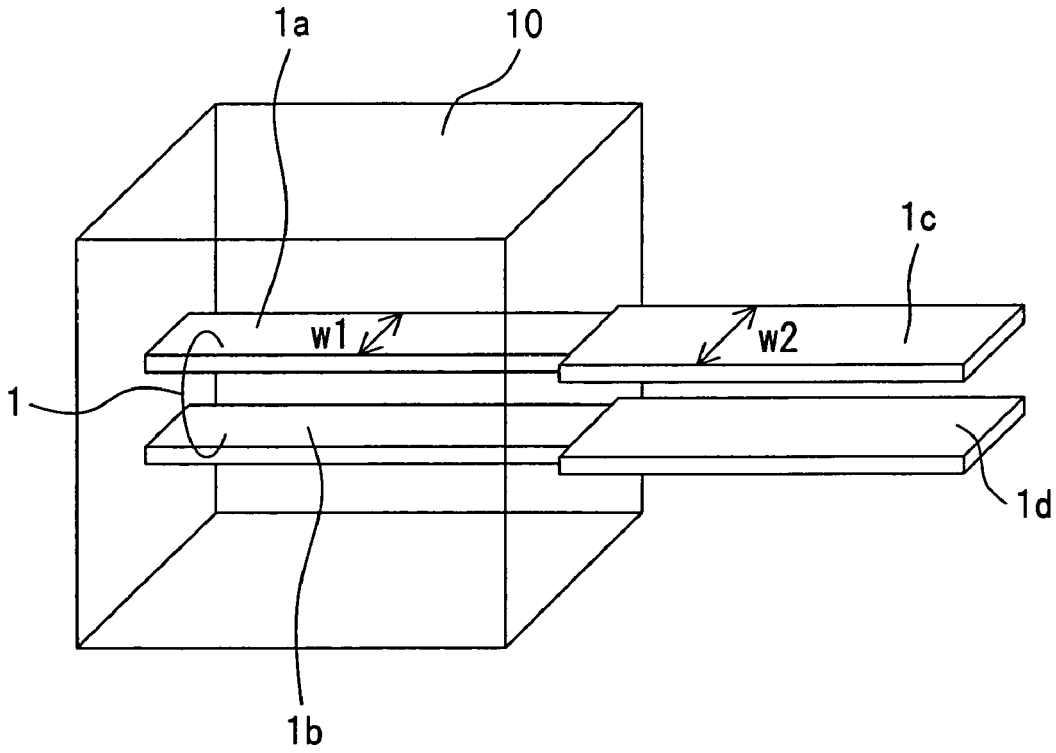
FIG. 7 is a perspective view showing a connection of a transmission line surrounded by a dielectric with the transmission line of the present preferred embodiment.

Although innumerable numbers of derivative structures can be naturally considered from the fundamental structure, another fundamental structure of the present invention is to concurrently serve as means having a structure for adjusting the dimensions so that the characteristic impedance $Z_0$ of the transmission line in the circuit is uniform up to the aperture portion 3 in order to secure the line conductor interval "d" that satisfies (¼)λg≦d. In order to maintain the characteristic impedance $Z_0$, the width "w" of the transmission line, which is a function of the interval "d", i.e., the Equation (3), is automatically determined. When using a method for making constant the sectional parameters of the width "w" of the transmission line, the interval "d" and the time "t" by extension and contraction in similitude, a shape as shown in FIG. 1 can be obtained. In order to minimize the turbulence of the electromagnetic fields, taper angles θ and ϕ (note that θ is the taper angle in the width direction of the transmission line, and ϕ is the taper angle in the longitudinal direction of the transmission line) should be preferably larger than zero degree and equal to or smaller than 30 degrees. Since the extension and contraction of similarity can freely be achieved, a gigantic antenna and a minute micro antenna are both possible and applied to all the sorts of applications. FIG. 7 shows one example of a structure of leading from a stacked pair line 1 of a width "w1" of the transmission line including a pair of line conductors 1*a* and 1*b* surrounded by a dielectric 10 to a stacked pair line (including a pair of line conductors 1*c* and 1*d*) of a width "w2 (>w1)" of the transmission line in the air.

Another important thing is that the electromagnetic waves traveling in the transmission line are in the TEM mode as understood from FIGS. 7 and 9 to 10, and then, it is necessary to provide means for accurately keeping the same state. One example is a method for embedding the whole transmission line configuration in the dielectric, and FIG. 7 shows a conceptual illustration. An electromagnetic wave velocity c is expressed by the following Equation (7):

$$c = \frac{c_0}{\sqrt{\mu_r \varepsilon_r}}. \quad (7)$$

In the Equation (7), $\mu_r$ is the relative magnetic permeability of the dielectric, and $\in_r$ is the specific inductive capacity of the dielectric. If a portion of a changed or different relative magnetic permeability or/and specific inductive capacity is formed in the transmission line, i.e., within the range in the cross section of traveling of the distribution of the effective electromagnetic lines of force in FIGS. 9 and 10, the electromagnetic lines of force in the portion are advanced or delayed, and this leads to collapse of the TEM mode. This is called the pseudo TEM mode, in which the spatial radiation efficiency is degraded by this coefficient as a result of time dispersion. It is desirable to completely enclose the transmission line with an insulator as shown in FIG. 7. For practical dimensional specifications, it is preferable to additionally expand the dielectric 10 by the width "w" of the transmission line on both sides in the plane and to expand the vertical dimension by the line length "d" in the profile.

Figure 2:
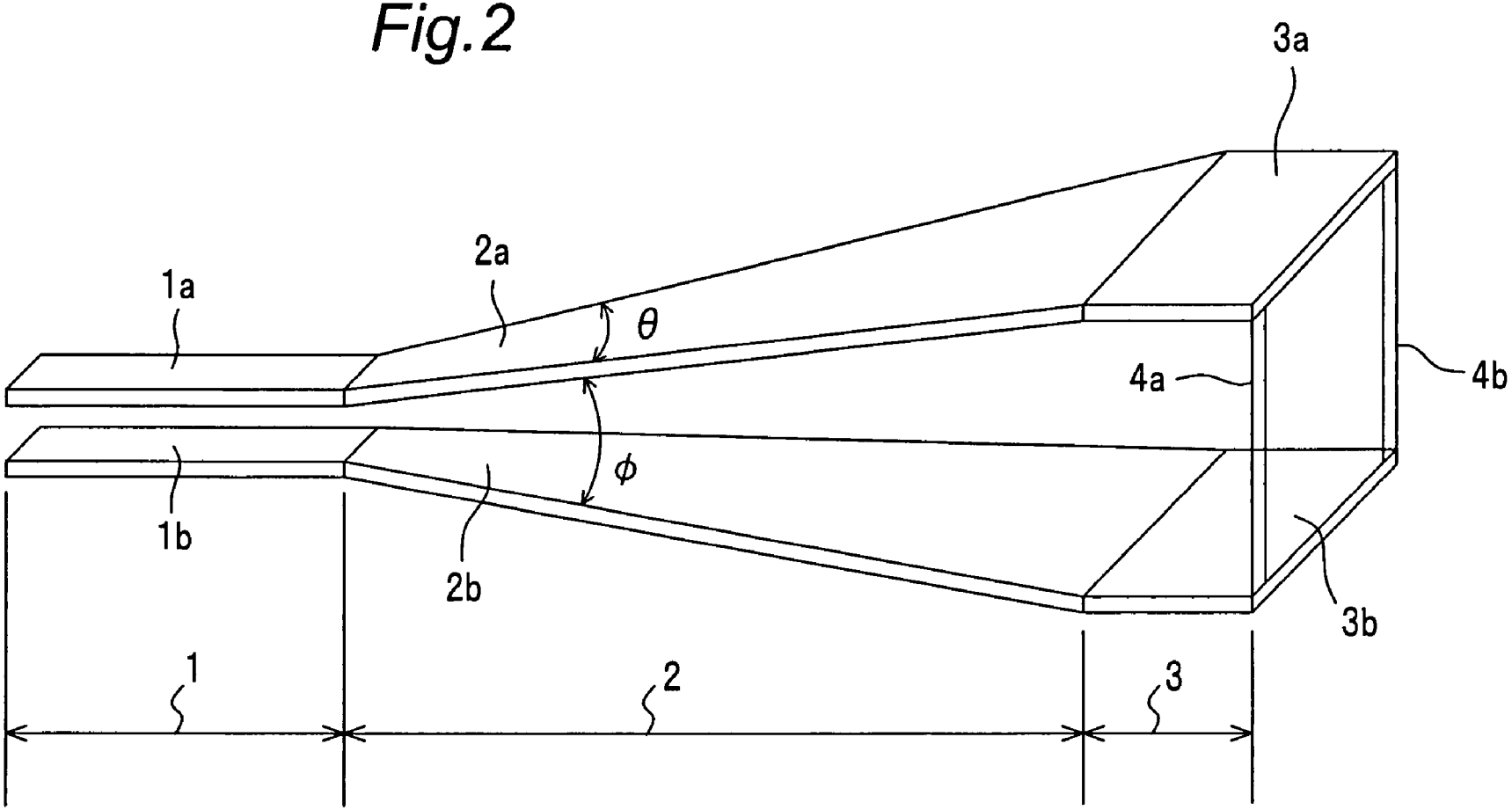
FIG. 2 is a perspective view showing an appearance of an antenna apparatus utilizing an aperture of transmission line according to a second preferred embodiment of the present invention.

FIG. 2 is a perspective view showing an appearance of an antenna apparatus utilizing an aperture of transmission line according to the second preferred embodiment of the present invention. Referring to FIG. 2, the antenna apparatus utilizing the aperture of transmission line of the second preferred embodiment is characterized in that support members 4*a* and 4*b* made of a metal or a dielectric for short-circuiting and supporting a pair of line conductors of the transmission line at both ends in the width direction of the transmission line of the aperture portion 3 are further provided as compared with that of the first preferred embodiment.

Figure 3:
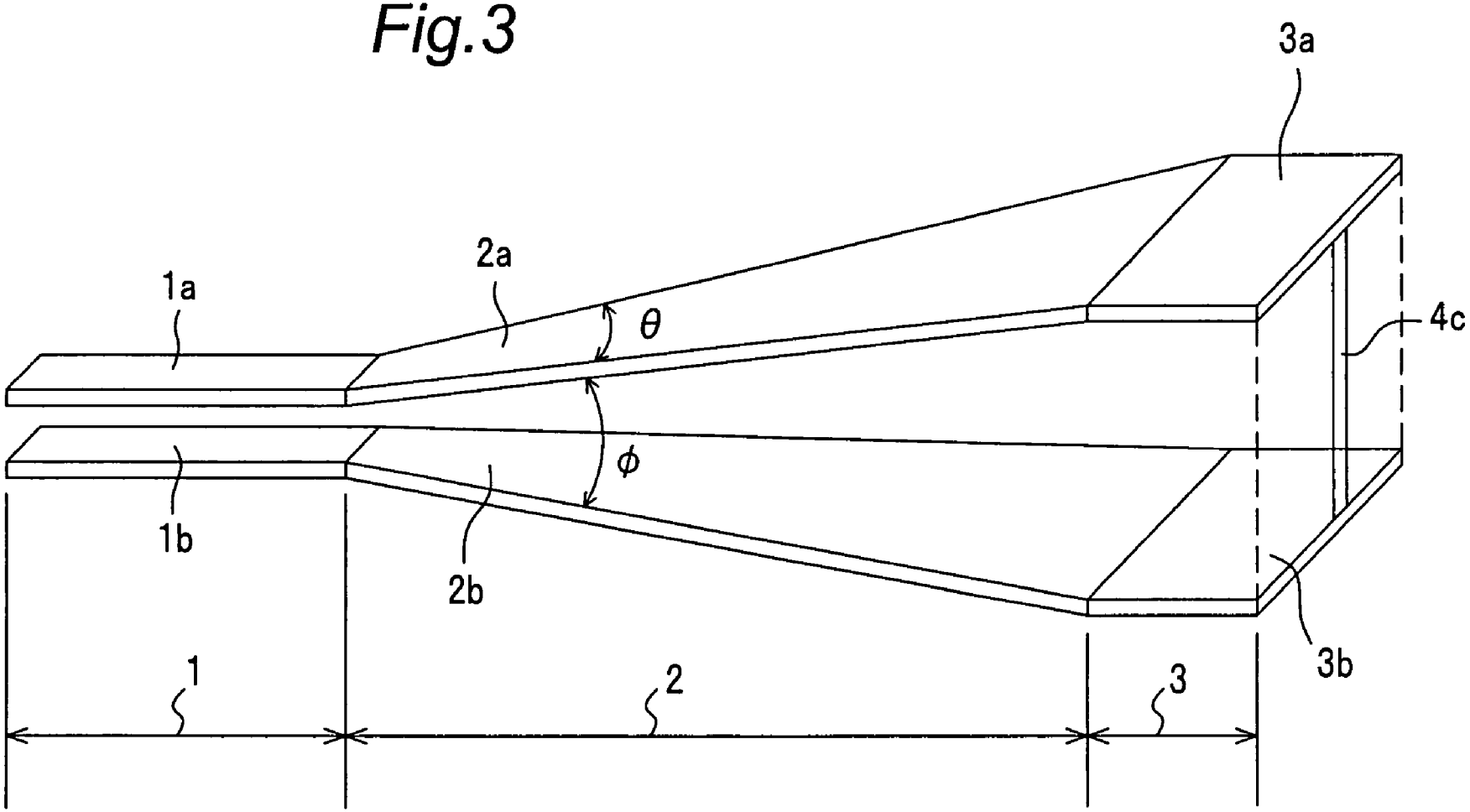
FIG. 3 is a perspective view showing an appearance of an antenna apparatus utilizing an aperture of transmission line according to a third preferred embodiment of the present invention.

FIG. 3 is a perspective view showing an appearance of an antenna apparatus utilizing an aperture of transmission line according to the third preferred embodiment of the present invention. Referring to FIG. 3, the antenna apparatus utilizing the aperture of transmission line of the third preferred embodiment is characterized in that a support member 4*c* made of a metal or a dielectric for short-circuiting and supporting a pair of line conductors 3*a* and 3*b* of the transmission line substantially in a center portion in the width direction of the transmission line of the aperture portion 3 is further provided as compared with that of the first preferred embodiment.

Figure 4:
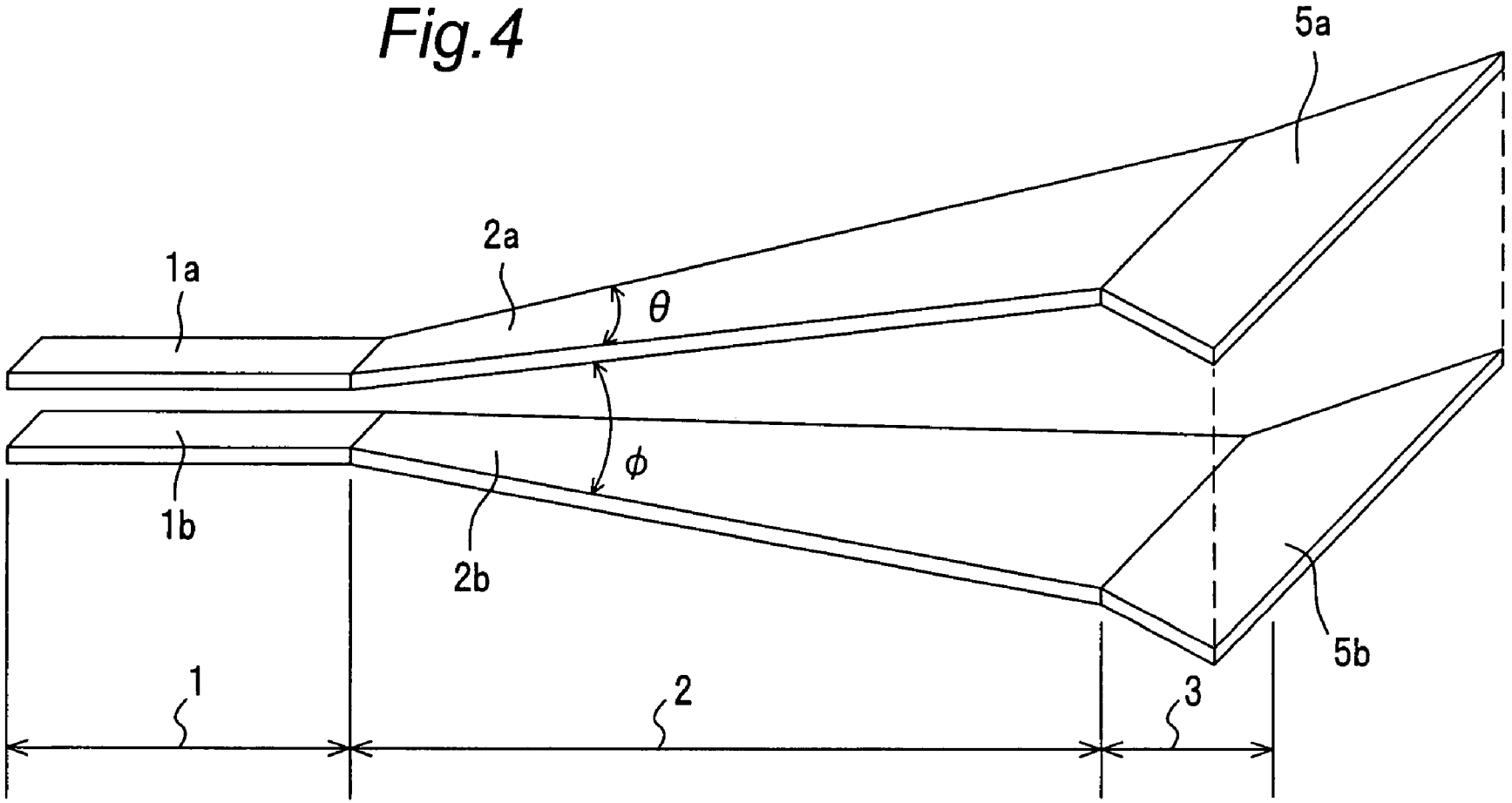
FIG. 4 is a perspective view showing an appearance of an antenna apparatus utilizing an aperture of transmission line according to a fourth preferred embodiment of the present invention.

FIG. 4 is a perspective view showing an appearance of an antenna apparatus utilizing an aperture of transmission line according to the fourth preferred embodiment of the present invention. The antenna apparatus utilizing the aperture of transmission line of the fourth preferred embodiment is characterized in that a pair of parallel planar line conductors 5*a* and 5*b* of the aperture portion 3 have its width of the transmission line expanded in a tapered shape as compared with that of the first preferred embodiment.

Figure 5:
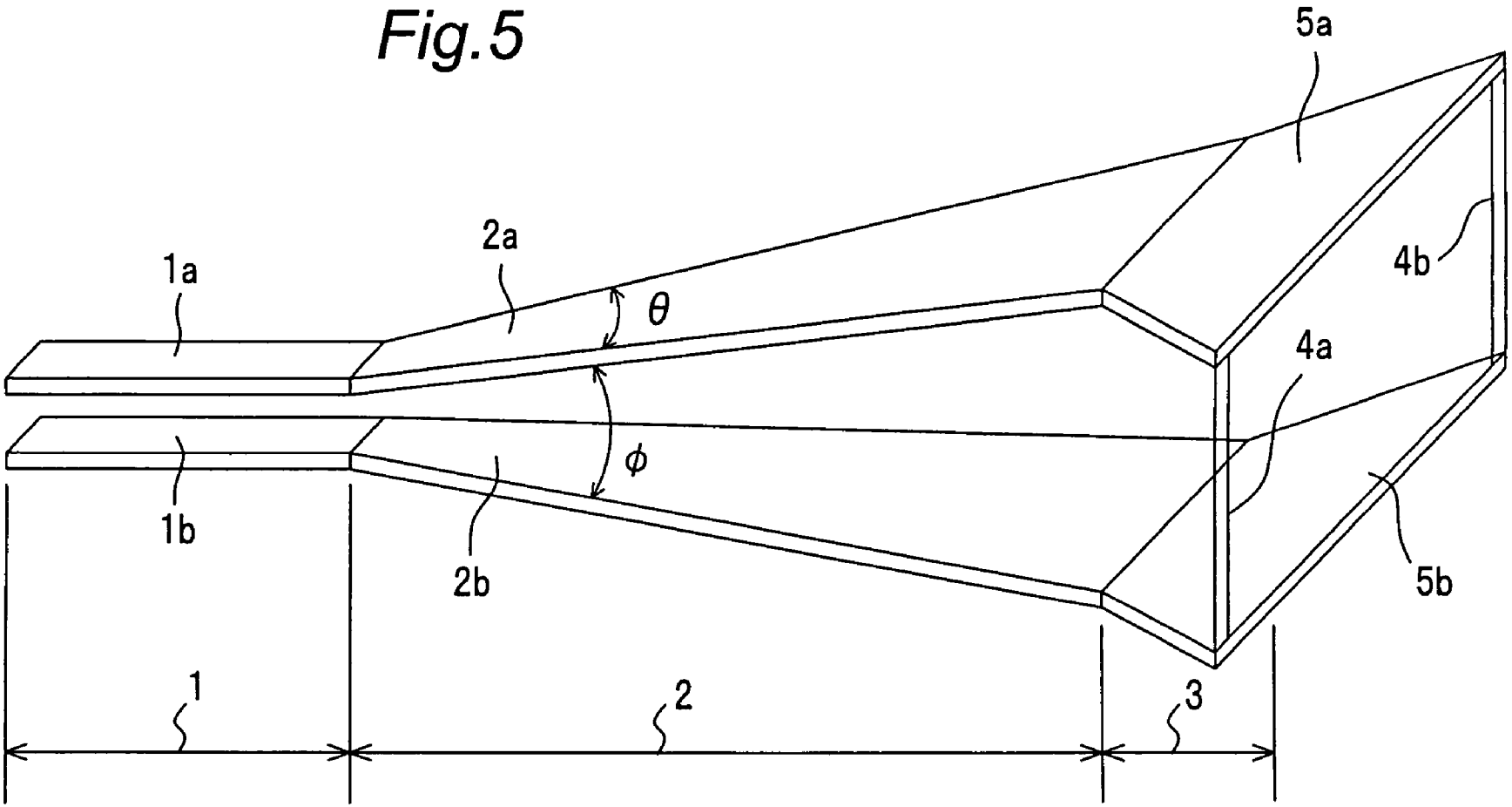
FIG. 5 is perspective view showing an appearance of an antenna apparatus utilizing an aperture of transmission line according to a fifth preferred embodiment of the present invention.

FIG. 5 is a perspective view showing an appearance of an antenna apparatus utilizing an aperture of transmission line according to the fifth preferred embodiment of the present invention. Referring to FIG. 5, the antenna apparatus utilizing the aperture of transmission line of the fifth preferred embodiment is characterized in that support members 4*a* and 4*b* made of a metal or a dielectric for short-circuiting and supporting a pair of line conductors 5*a* and 5*b* of the transmission line at both ends in the width direction of the transmission line of the aperture portion 3 are further provided as compared with that of the fourth preferred embodiment.

Figure 6:
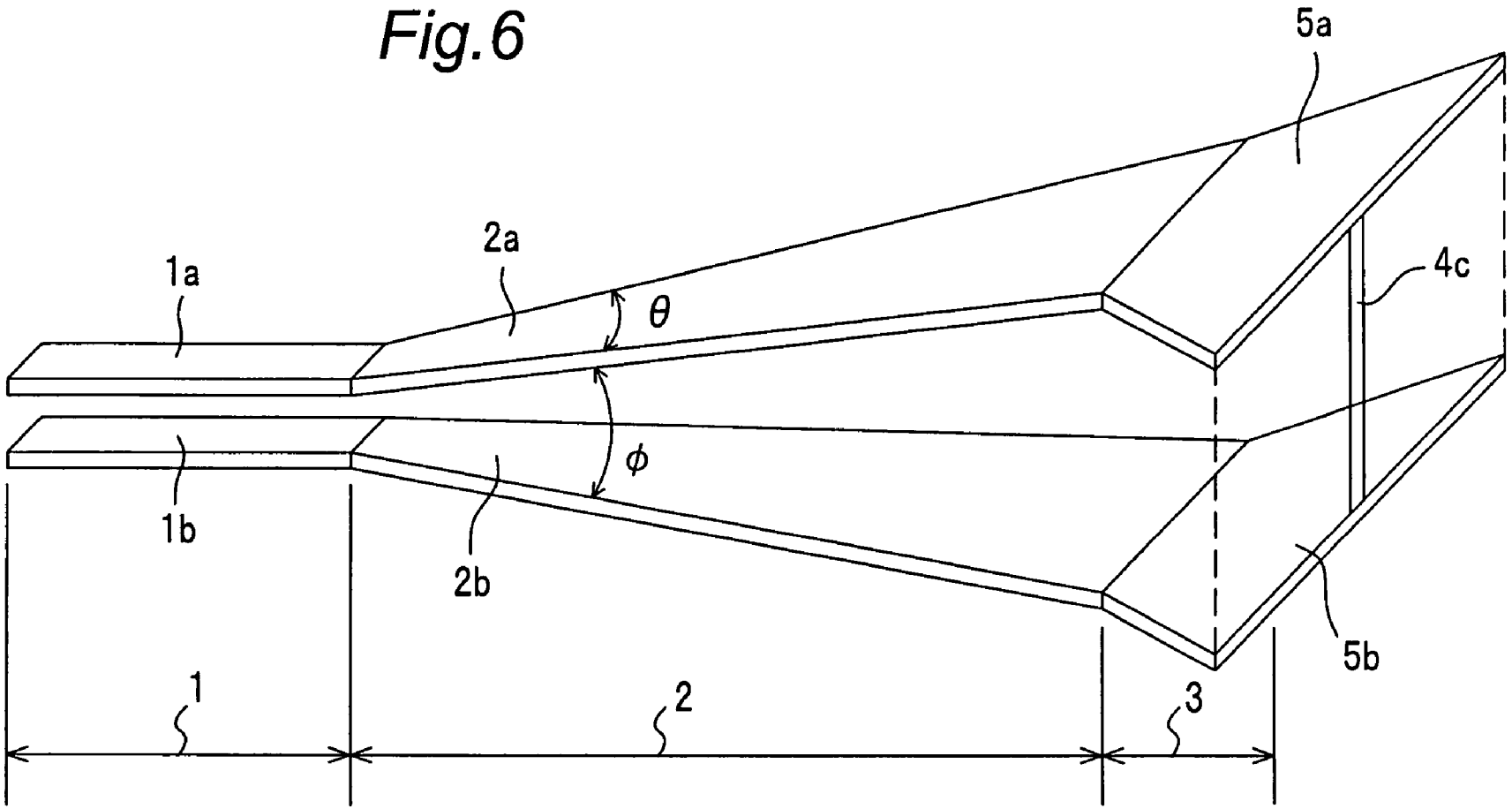
FIG. 6 is a perspective view showing an appearance of an antenna apparatus utilizing an aperture of transmission line according to a sixth preferred embodiment of the present invention.

FIG. 6 is a perspective view showing an appearance of an antenna apparatus utilizing an aperture of transmission line according to the sixth preferred embodiment of the present invention. Referring to FIG. 6, the antenna apparatus utilizing the aperture of transmission line of the sixth preferred embodiment is characterized in that a support member 4*c* made of a metal or a dielectric for short-circuiting and supporting a pair of line conductors 5*a* and 5*b* of the transmission line substantially in a center portion in the width direction of the transmission line of the aperture portion 3 is further provided as compared with that of the fourth preferred embodiment.

Although the stacked pair line 1 is employed as an input line in each of the above-mentioned preferred embodiments, the present invention is not limited to this, and it is acceptable to connect another unbalanced type cable or transmission line, such as a coaxial cable, via an unbalanced connector.

Figure 30:
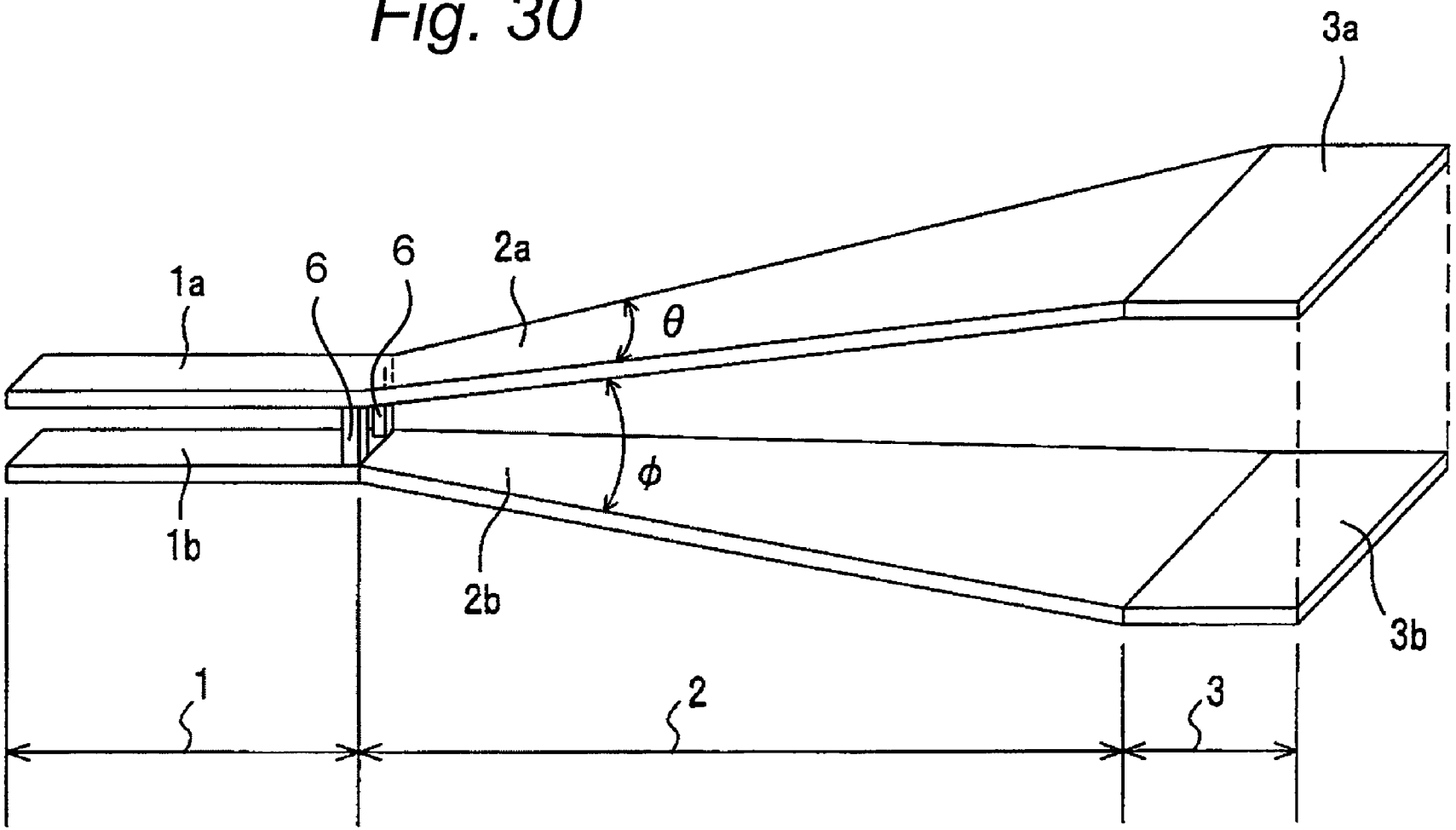
FIG. 30 is a perspective view showing an appearance of an antenna apparatus utilizing an aperture of transmission line according to a seventh preferred embodiment of the present invention.

Furthermore, in each of the above-mentioned preferred embodiments, it is acceptable to fill a space located between a pair of line conductors 3*a* and 3*b* or 5*a* and 5*b* of the aperture portion 3 with a predetermined dielectric that supports the line conductors. Moreover, it is acceptable to further provide a support member 6 made of a dielectric for supporting both ends in the width direction of the transmission line of the tapered line portion 2 with interposition of a predetermined interval, as illustrated in FIG. 30. Furthermore, it is acceptable to further provide a support member made of a dielectric for supporting both ends in the width direction of the transmission line of the aperture portion 3 with interposition of a predetermined interval.

The taper angles θ and ϕ is preferably set to a predetermined value that is larger than zero degree and equal to or smaller than 30 degrees. Moreover, the characteristic impedance $Z_0$ of the stacked pair line 1, the tapered line portion 2 and the aperture portion 3 are preferably set to a predetermined value that is equal to or larger than 50Ω and equal to or smaller than 100 Ω.

Although it is preferable to provide the setting of $(1/4)\lambda g \leqq d$ in each of the above-mentioned preferred embodiments, the similar action and advantageous effects can be obtained even with the setting of $(1/4)\lambda g \leqq w$.

IMPLEMENTAL EXAMPLES

Next, the simulations and results conducted by the present inventors and others will be described below.

Figure 15:
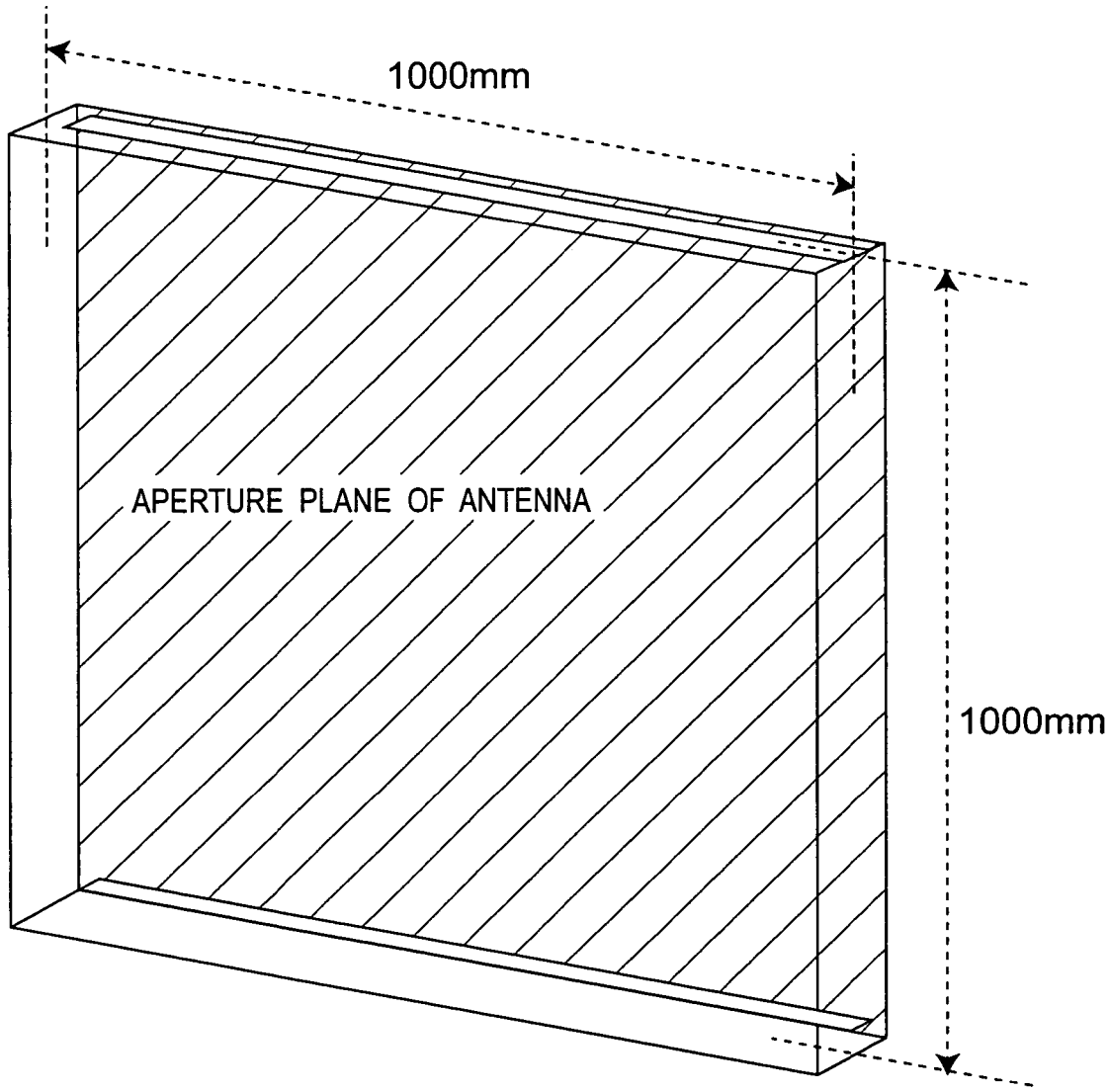
FIG. 15 is a perspective view showing an antenna aperture plane of an antenna apparatus utilizing an aperture of transmission line used in simulations of the present preferred embodiment.
Figure 16:
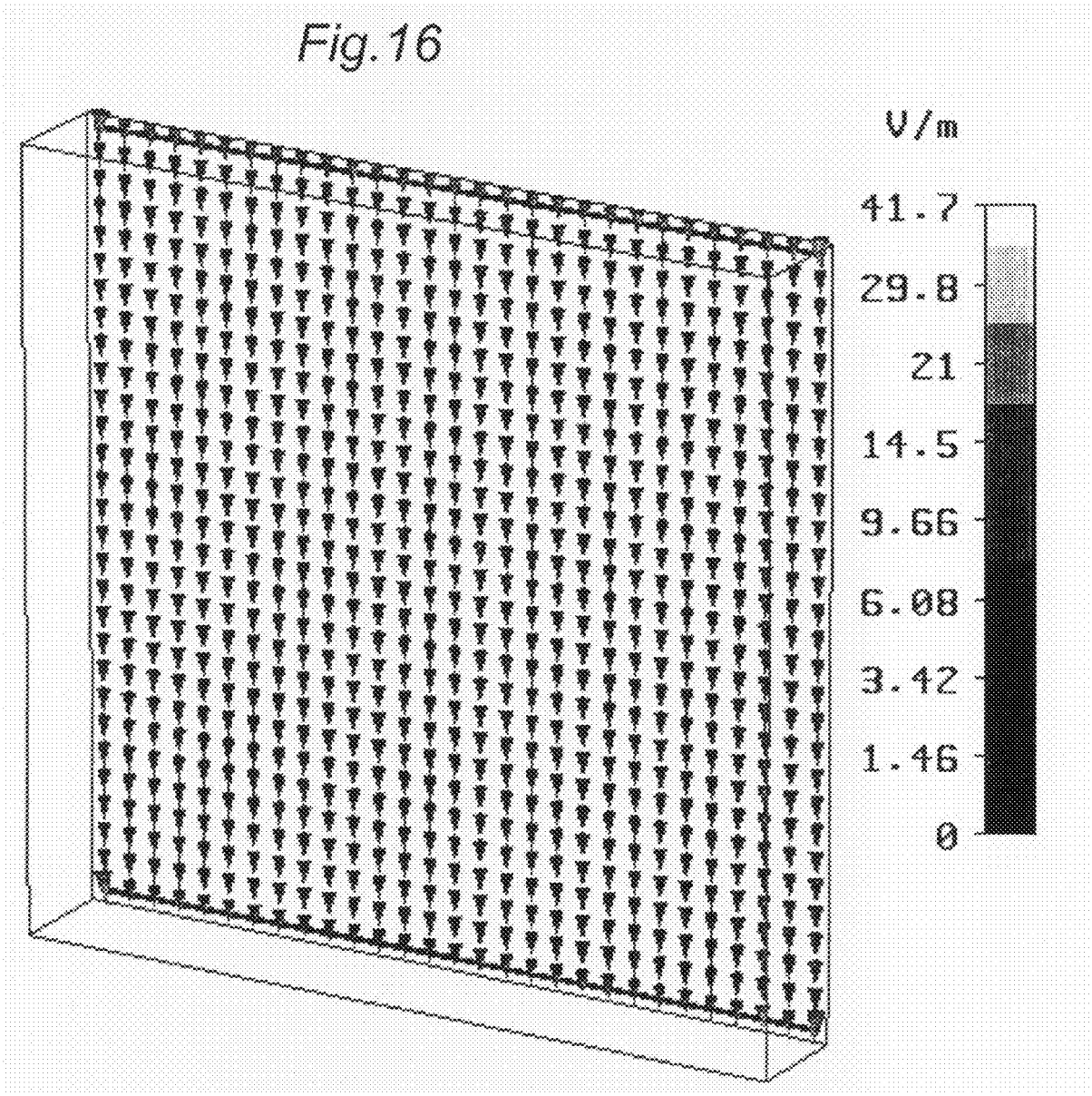
FIG. 16 is a perspective view showing an electric field of a port on the antenna aperture plane of the antenna apparatus utilizing the aperture of transmission line used in the simulations of the present preferred embodiment.
Figure 17:
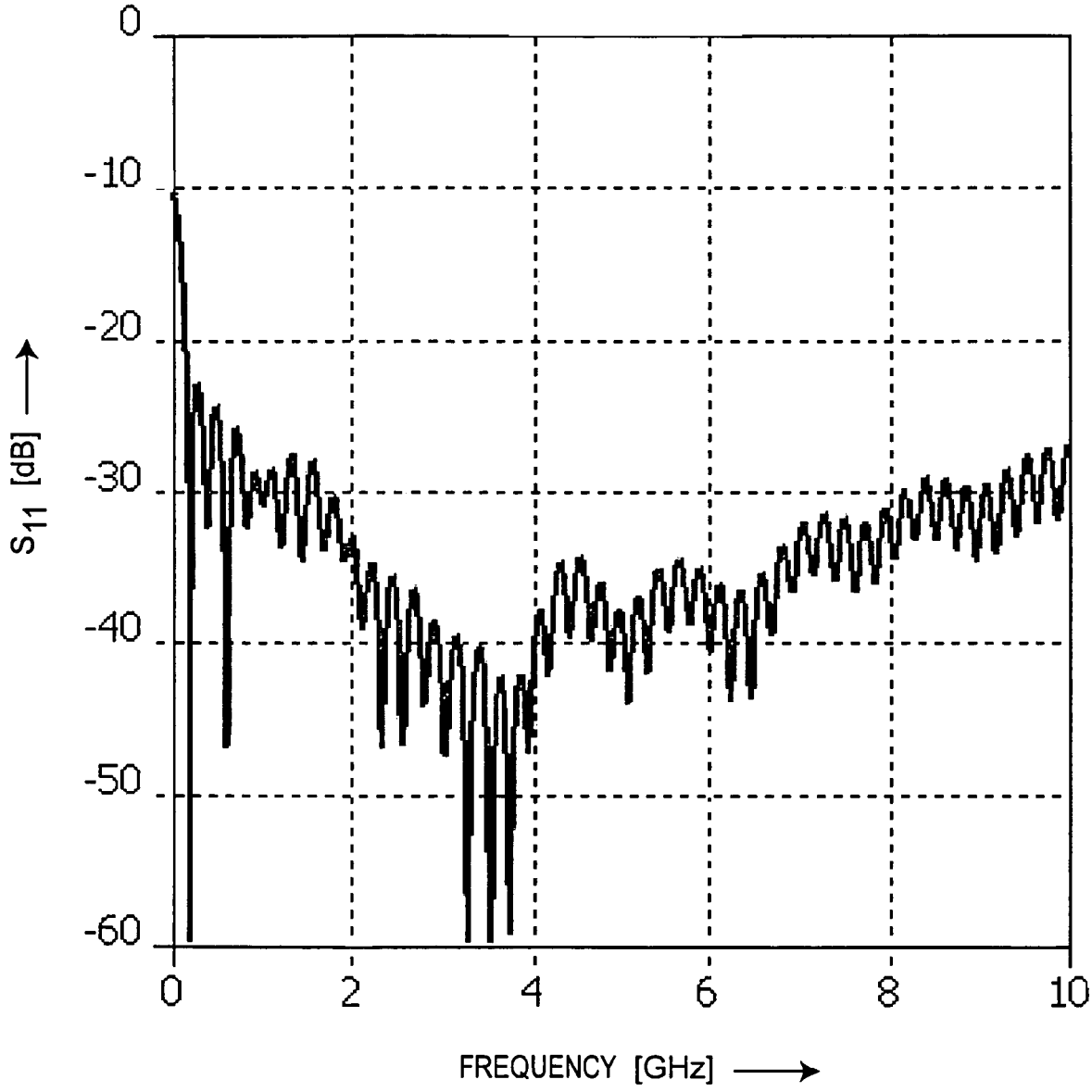
FIG. 17 is a graph showing a frequency characteristic of a reflection coefficient $S_{11}$ of the antenna apparatus utilizing the aperture of transmission line used in the simulations of the present preferred embodiment.
Figure 18:
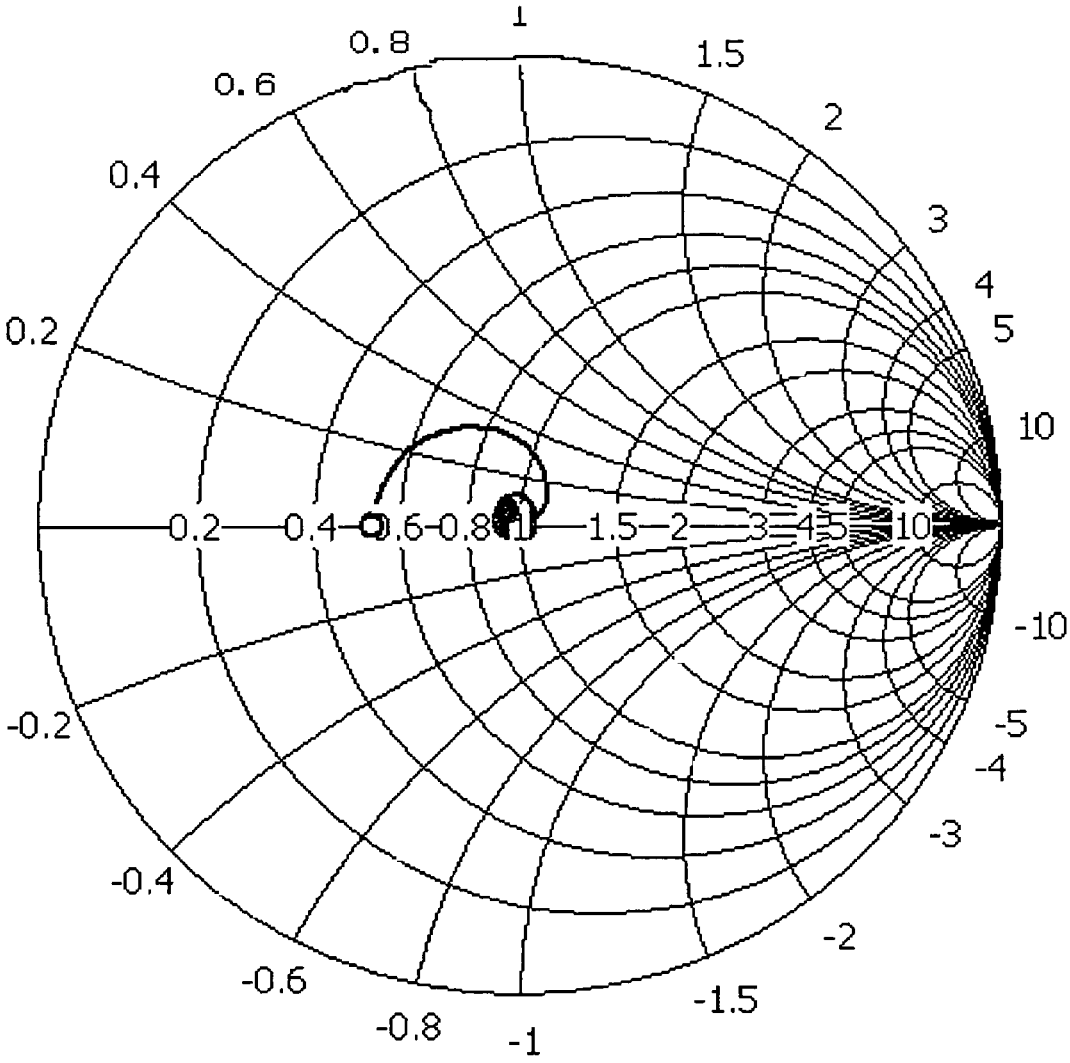
FIG. 18 is a Smith chart showing an impedance characteristic at the input terminal of the antenna apparatus utilizing the aperture of transmission line used in the simulations of the present preferred embodiment.

FIG. 15 is a perspective view showing an antenna aperture plane of the antenna apparatus utilizing the aperture of transmission line used in the simulations of the present preferred embodiment. FIG. 16 is a perspective view showing an electric field [V/m] of a port on the antenna aperture plane of the antenna apparatus utilizing the aperture of transmission line used in the simulations of the present preferred embodiment. In addition, FIG. 17 is a graph showing a frequency characteristic (the frequency ranging from 0 to 10 GHz) of the reflection coefficient $S_{11}$ [dB] of the antenna apparatus utilizing the aperture of transmission line used in the simulations of the present preferred embodiment. Further, FIG. 18 is a Smith chart showing an impedance characteristic at the input terminal of the antenna apparatus utilizing the aperture of transmission line used in the simulations of the present preferred embodiment.

FIGS. 15 to 18 show the reflection and the impedance characteristic of the antenna apparatus utilizing the aperture of transmission line of an aperture plane of 1 m×1 m, in which the characteristics toward the space when the aperture portion 3 is used as a port are shown. As is apparent from FIG. 16, it can be understood that there are TEM waves with uniform field intensities (at the waveguide port) throughout the entire aperture plane. It is preferably better for the reflection energy (reflection coefficient $S_{11}$ when indicated by the S parameter) to be smaller when directed toward the space. As is apparent from FIG. 17, (¼)λ=1000 mm and λ=75 MHz result because w=d=1 m. At the frequency, the reflection coefficient $S_{11}$=−23 dB, which is very small, and the level equal to or smaller than −30 dB is maintained at higher frequency bands. We have never seen such any antenna having almost no frequency characteristic and emitting electromagnetic radiation so efficiently as described above. Moreover, as is apparent from the Smith chart of FIG. 18, although the aperture portion 3 has a characteristic impedance of 194Ω (o in FIG. 18), it can be understood that the characteristic impedance is 376Ω (● in FIG. 18) so as to be impedance-matched with that of the spatial electromagnetic impedance at 10 GHz due to the electromagnetic resonance (imaginary part) of reflection.

FIG. 19A is a graph showing a directional pattern at 1 GHz of the antenna apparatus utilizing the aperture of transmission line used in the simulations of the present preferred embodiment. FIG. 19A shows the directional pattern having directivity gains in a range from 21.6 to −18.4 dBi, and the antenna apparatus has the maximum directivity gain of about 22 dBi.

FIG. 19B is a graph showing a directional pattern at 2.5 GHz of the antenna apparatus utilizing the aperture of transmission line used in the simulations of the present preferred embodiment. FIG. 19B shows the directional pattern having directivity gains in a range from 29.5 to −10.5 dBi, and the antenna apparatus has the maximum directivity gain of about 30 dBi.

FIG. 19C is a graph showing a directional pattern at 5 GHz of the antenna apparatus utilizing the aperture of transmission line used in the simulations of the present preferred embodiment. FIG. 19C shows the directional pattern having directivity gains in a range from 35.5 to −4.45 dBi, and the antenna apparatus has the maximum directivity gain of about 36 dBi.

FIG. 19D is a graph showing a directional pattern at 7.5 GHz of the antenna apparatus utilizing the aperture of transmission line used in the simulations of the present preferred embodiment. FIG. 19D shows the directional pattern having directivity gains in a range from 39.0 to −0.977 dBi, and the antenna apparatus has the maximum directivity gain of about 39 dBi.

FIG. 19E is a graph showing a directional pattern at 10 GHz of the antenna apparatus utilizing the aperture of transmission line used in the simulations of the present preferred embodiment. FIG. 19E shows the directional pattern having directivity gains in a range from 41.5 to 1.48 dBi, and the antenna apparatus has the maximum directivity gain of about 41 dBi.

As is apparent from FIGS. 19A to 19E, the gain is about 22 dBi even with the directivity at a comparatively low frequency of 1 GHz, and the antenna apparatus having such an excellent directivity has not been conventionally found out.

Figure 20A:
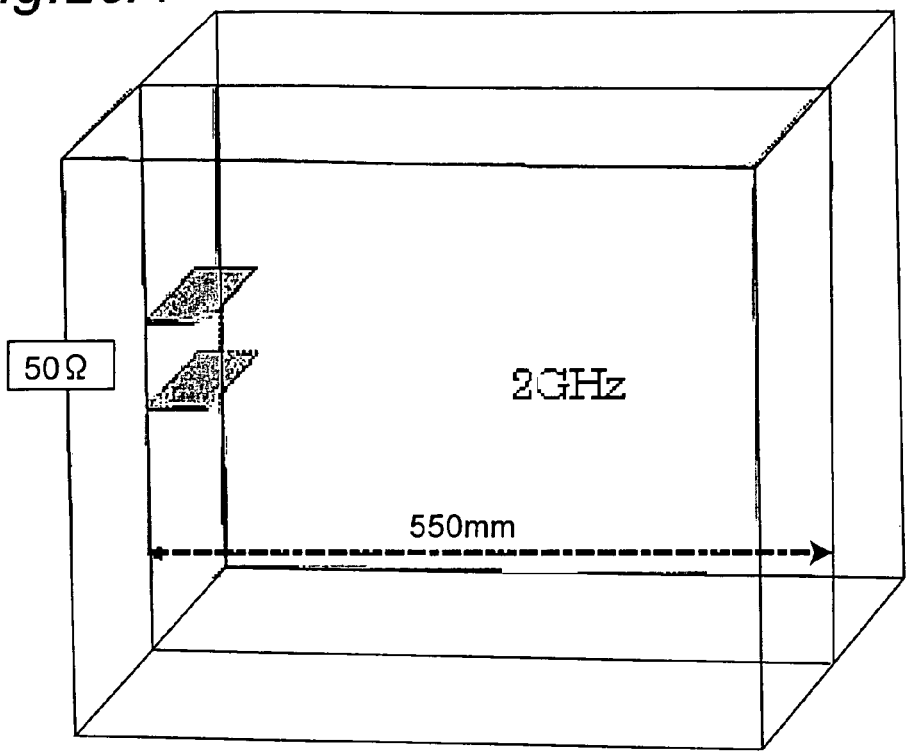
FIG. 20A is a graph showing a spatial distribution of an electromagnetic radiation at 2 GHz from the antenna apparatus utilizing the aperture of transmission line used in the simulations of the present preferred embodiment, where the antenna apparatus has the aperture of d=70 mm, w=460 mm, and Zo=50Ω, at (¼)λ=1.11 GHz, and the electric field strength is in a range to about 158 V/m.
Figure 20B:
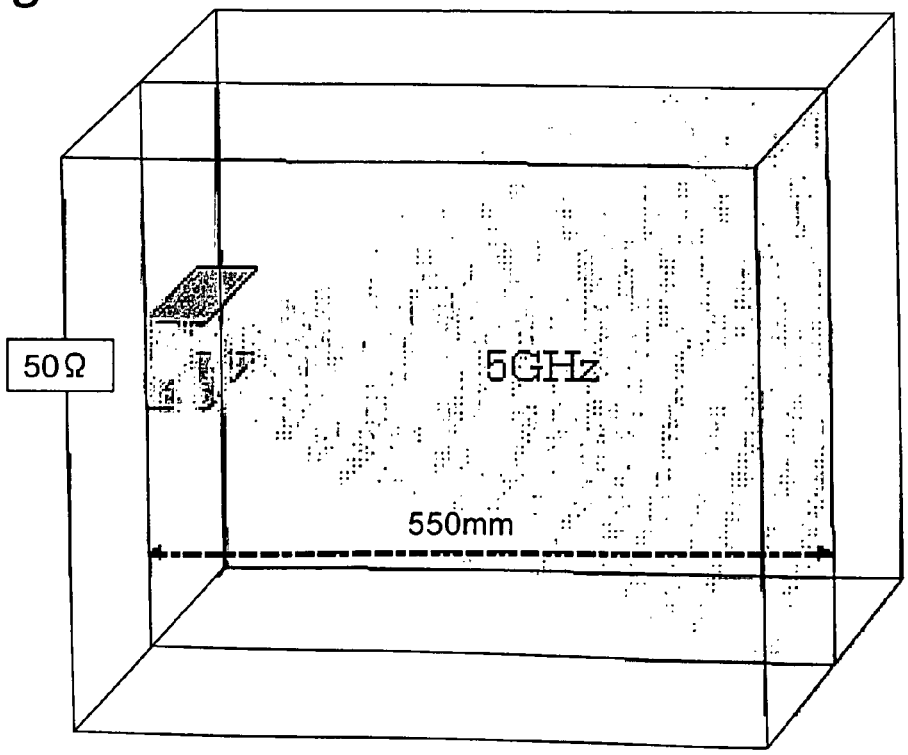
FIG. 20B is a graph showing a spatial distribution of an electromagnetic radiation at 5 GHz from the antenna apparatus utilizing the aperture of transmission line used in the simulations of the present preferred embodiment, where the antenna apparatus has the aperture of d=70 mm, w=460 mm, and Zo=50Ω, at (¼)λ=1.11 GHz, and the electric field strength is in a range to about 158 V/m.
Figure 20C:
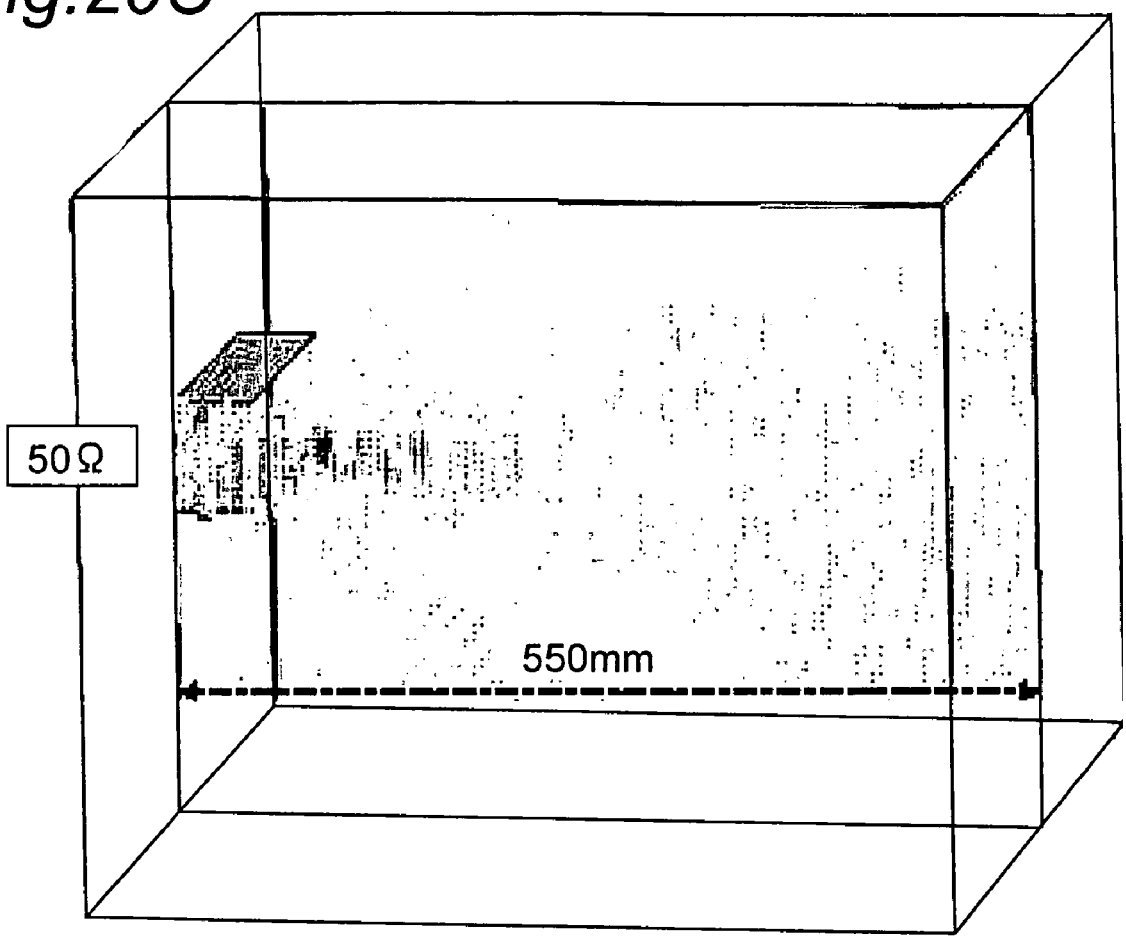
FIG. 20C is a graph showing a spatial distribution of an electromagnetic radiation at 10 GHz from the antenna apparatus utilizing the aperture of transmission line used in the simulations of the present preferred embodiment, where the antenna apparatus has the aperture of d=70 mm, w=460 mm, and Zo=50Ω, at (¼)λ=1.11 GHz, and the electric field strength is in a range to about 138 V/m.

FIGS. 20A, 20B and 20C are graphs showing spatial distributions of electromagnetic radiations at operating frequencies of 2, 5 and 10 GHz from the antenna apparatus utilizing the aperture of transmission line having a characteristic impedance of 50Ω used in the simulations of the present preferred embodiment, where the antenna apparatus has the aperture of d=70 mm, w=460 mm, and Zo=50Ω, at (¼) λ=1.11 GHz, and the electric field strength is in a range to about 158 V/m.

Figure 21A:
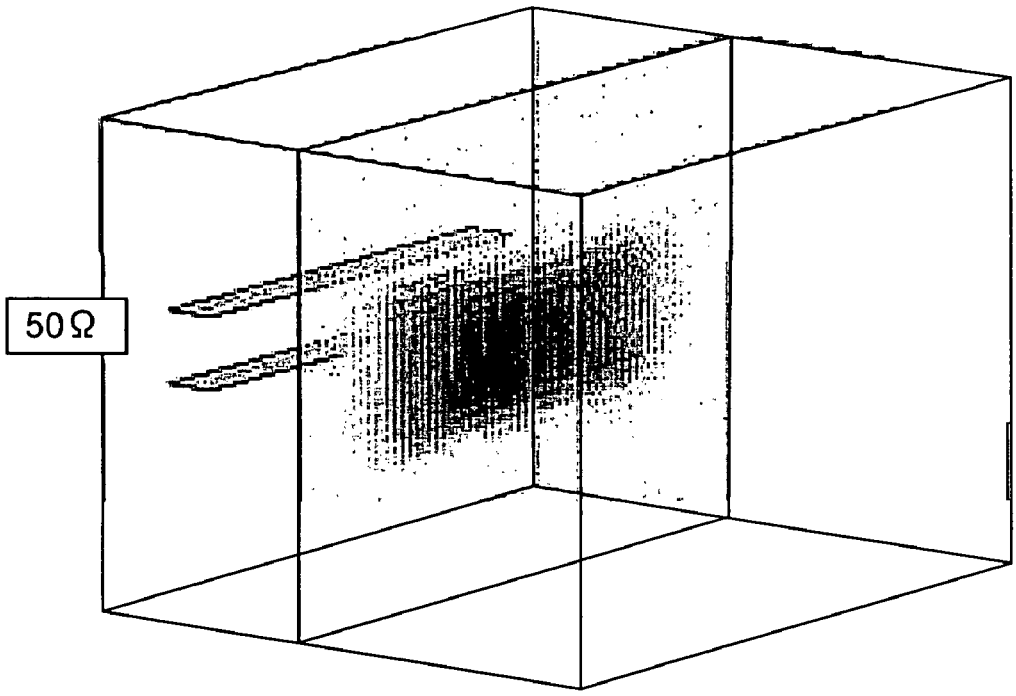
FIG. 21A is a graph showing an energy distribution of an electromagnetic radiation field at 2 GHz at a location apart by 200 mm from the aperture plane of the antenna apparatus utilizing the aperture of transmission line used in the simulations of the present preferred embodiment.

FIG. 21A is a graph showing an energy distribution of an electromagnetic radiation field at 2 GHz at a location apart by 200 mm from the aperture plane of the antenna apparatus utilizing the aperture of transmission line used in the simulations of the present preferred embodiment. FIG. 21A shows radiation distributions of electric field strengths in a range to 49.8 V/m.

Figure 21B:
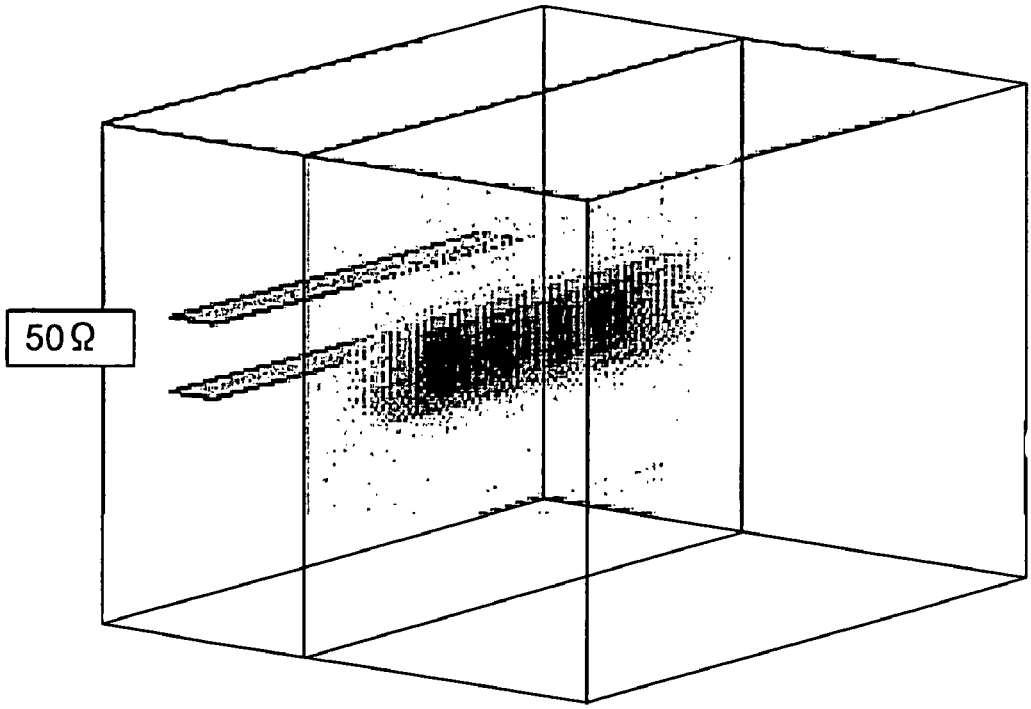
FIG. 21B is a graph showing an energy distribution of an electromagnetic radiation field at 5 GHz at a location apart by 200 mm from the aperture plane of the antenna apparatus utilizing the aperture of transmission line used in the simulations of the present preferred embodiment.

FIG. 21B is a graph showing an energy distribution of an electromagnetic radiation field at 5 GHz at a location apart by 200 mm from the aperture plane of the antenna apparatus utilizing the aperture of transmission line used in the simulations of the present preferred embodiment. FIG. 21B shows radiation distributions of electric field strengths in a range to 77.7 V/m.

Figure 21C:
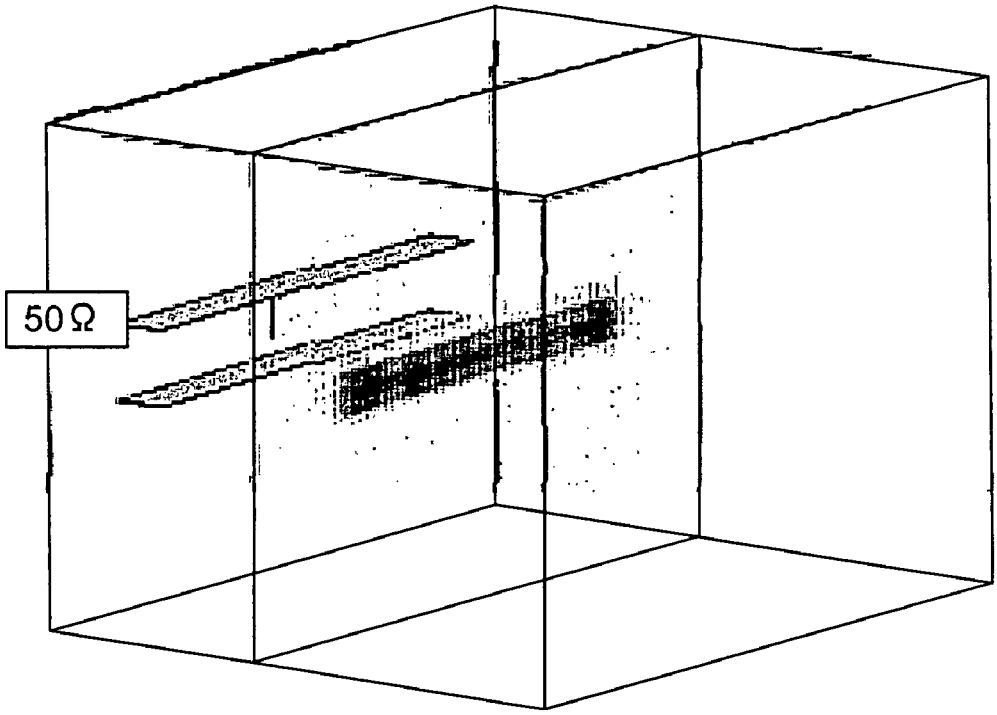
FIG. 21C is a graph showing an energy distribution of an electromagnetic radiation field at 10 GHz at a location apart by 200 mm from the aperture plane of the antenna apparatus utilizing the aperture of transmission line used in the simulations of the present preferred embodiment.

FIG. 21C is a graph showing an energy distribution of an electromagnetic radiation field at 10 GHz at a location apart by 200 mm from the aperture plane of the antenna apparatus utilizing the aperture of transmission line used in the simulations of the present preferred embodiment. FIG. 21C shows radiation distributions of electric field strengths in a range to 87.6 V/m.

Figure 21D:
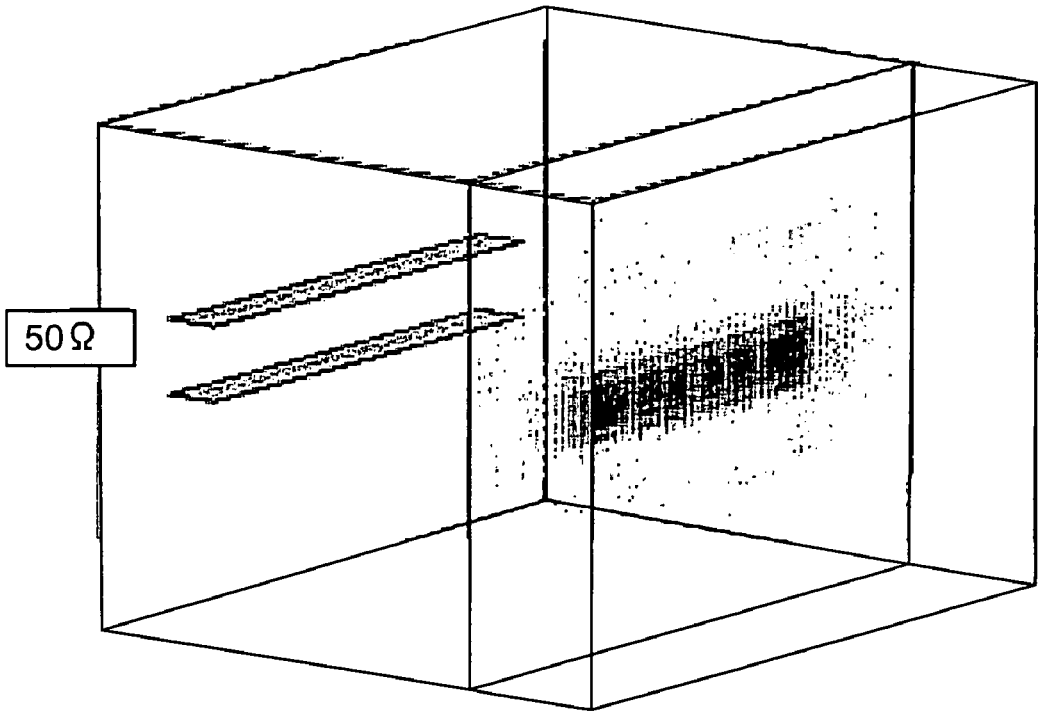
FIG. 21D is a graph showing an energy distribution of an electromagnetic radiation field at 10 GHz at a location apart by 400 mm from the aperture plane of the antenna apparatus utilizing the aperture of transmission line used in the simulations of the present preferred embodiment.

FIG. 21D is a graph showing an energy distribution of an electromagnetic radiation field at 10 GHz at a location apart by 400 mm from the aperture plane of the antenna apparatus utilizing the aperture of transmission line used in the simulations of the present preferred embodiment. FIG. 21D shows radiation distributions of electric field strengths in a range to 69.3 V/m.

FIGS. 21A to 21D show the degree of energy concentrations in the space of the antenna apparatus utilizing the aperture of transmission line of d=70 mm and w=460 mm. As is apparent from FIGS. 21A to 21D, although (¼)λ is 1.11 GHz and the reflection is equal to or smaller than −20 dB at 2 GHz, the state of dispersion doubled or more has already occurred at a location 200 mm apart from the aperture plane. However, almost no dispersion occurs in the transverse direction. Although the dispersion is reduced when the frequency is raised, side lobes are observed on the upper and lower sides. Almost no dispersion occurs in the transverse direction also in the case, and it can be anticipated that an azimuth on a map can be sufficiently taken with respect to the ground surface of communications. The aperture areas and the directivity gains are brought together and shown in Table 2.

TABLE 2

Aperture Plane Dimensions and Directivity Gains [dBi]

| Aperture Sizes [mm] | 1 GHz | 5 GHz | 10 GHz |
|---|---|---|---|
| 100 × 100 | 3.967 | 18.42 | 23.58 |
| 300 × 300 | 11.15 | 26.32 | 32.13 |
| 500 × 500 | 16.11 | 30.40 | 36.23 |
| 1000 × 1000 | 21.72 | 35.91 | 41.81 |

It can be understood from the results in Table 2 that more excellent antenna characteristics can be obtained with respect to the directivity, as the aperture plane is larger.

Figure 22:
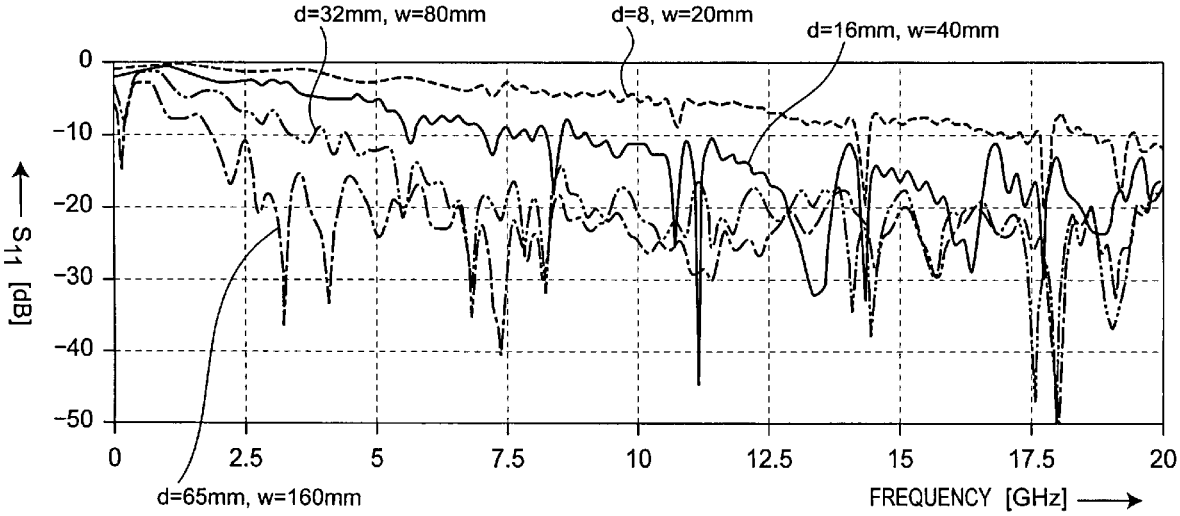
FIG. 22 is a graph showing an aperture area and a frequency characteristic of a reflection coefficient $S_{11}$ on the aperture plane of the antenna apparatus utilizing the aperture of transmission line used in the simulations of the present preferred embodiment.

FIG. 22 is a graph showing an aperture area and a frequency characteristic of the reflection coefficient $S_{11}$ on the aperture plane of the antenna apparatus utilizing the aperture of transmission line having a characteristic impedance $Z_0$=100Ω used in the simulations of the present preferred embodiment. FIG. 22 shows the frequency characteristic of reflection when the aperture area is changed with the characteristic impedance $Z_0$ of the antenna apparatus utilizing the aperture of transmission line maintained to be 100 Ω.

Figure 23A:
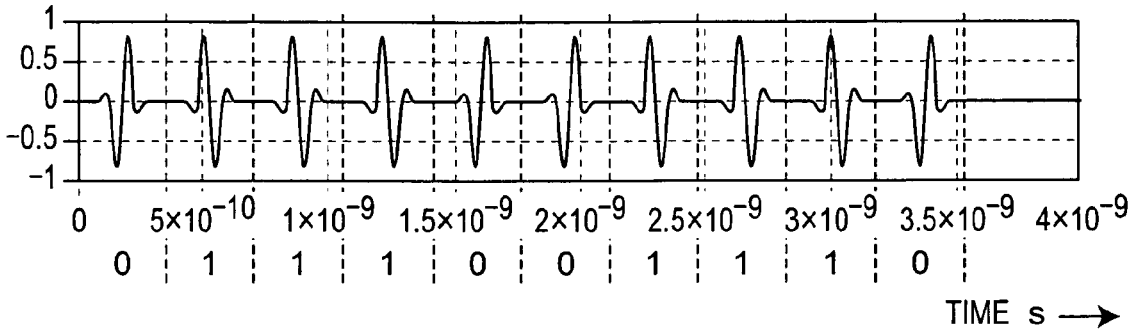
FIG. 23A is a waveform chart showing an incident received signal waveform of Gaussian pulses of the antenna apparatus utilizing the aperture of transmission line used in the simulations of the present preferred embodiment.
Figure 23B:
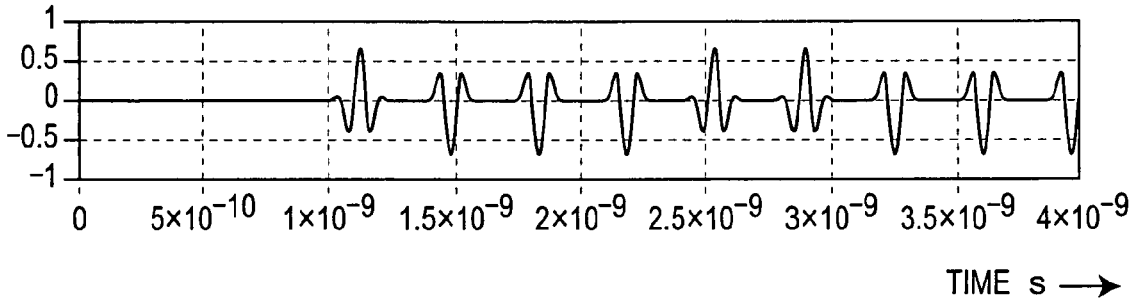
FIG. 23B is a waveform chart showing a received signal waveform of Gaussian pulses of the antenna apparatus with an antenna interval of 10 mm utilizing the aperture of transmission line used in the simulations of the present preferred embodiment.
Figure 23C:
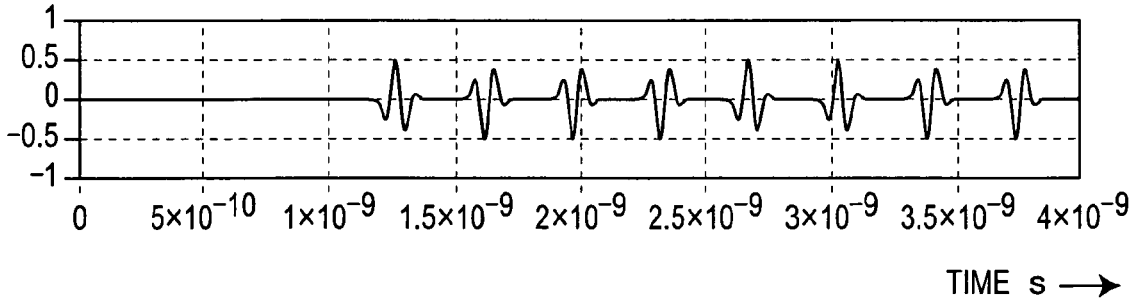
FIG. 23C is a waveform chart showing a received signal waveform of Gaussian pulses of the antenna apparatus with an antenna interval of 30 mm utilizing the aperture of transmission line used in the simulations of the present preferred embodiment.
Figure 23D:
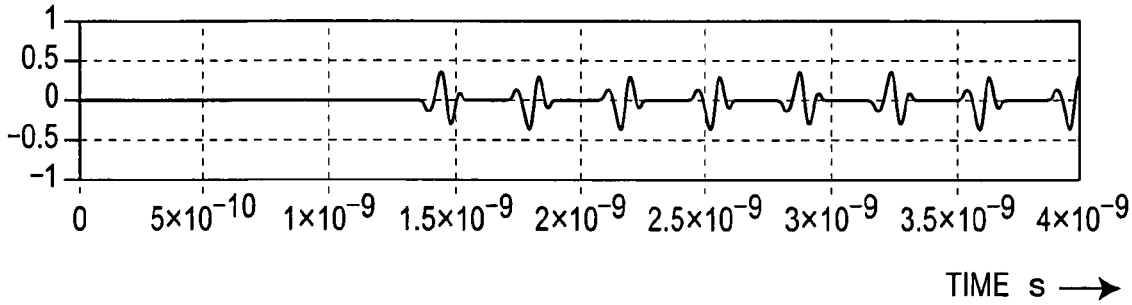
FIG. 23D is a waveform chart showing a received signal waveform of Gaussian pulses of the antenna apparatus with an antenna interval of 60 mm utilizing the aperture of transmission line used in the simulations of the present preferred embodiment.

FIG. 23A is a waveform chart showing an incident received signal waveform of Gaussian pulses of the antenna apparatus utilizing the aperture of transmission line used in the simulations of the present preferred embodiment, FIG. 23B is a waveform chart showing a received signal waveform of Gaussian pulses of the antenna apparatus with an antenna interval of 10 mm, FIG. 23C is a waveform chart showing a received signal waveform of Gaussian pulses of the antenna apparatus with an antenna interval of 30 mm, and FIG. 23D is a waveform chart showing a received signal waveform of Gaussian pulses of the antenna apparatus with an antenna interval of 60 mm. Namely, FIGS. 23A to 23D shows the receiving characteristic at the time of Gaussian pulse by using an antenna apparatus utilizing an aperture of transmission line of d=32 mm is used for transmitting and receiving. The Gaussian pulse receiving characteristics when a pair of transmission line aperture type antenna apparatuses of d=32 mm and w=80 mm are opposed to each other and used for transmitting and receiving are shown with the antenna interval changed to 10 mm, 30 mm, and 60 mm. Moreover, the frequency components of the Gaussian pulse were set to composite waves that flatly contain energies from 0.01 GHz to 20 GHz. In this case, waveforms receivable at d=60 mm are shown. However, as is apparent from FIG. 22, the reflection coefficient $S_{11}$ becomes −20 dB at 6.5 GHz, and therefore, the frequency characteristic does not become flat, meaning that the transmitting characteristic is not so good.

Figure 24A:
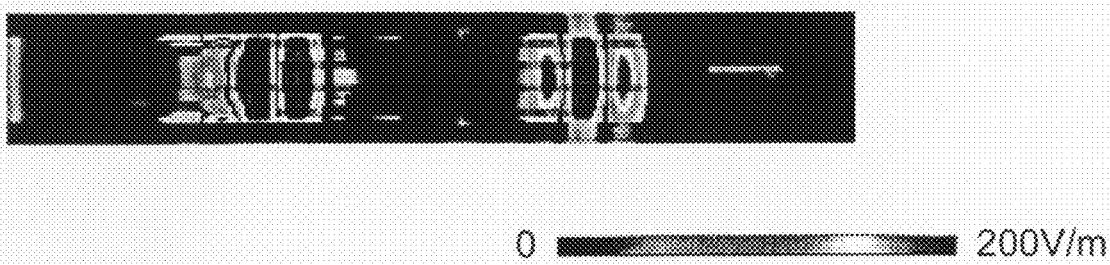
FIG. 24A is a chart showing transmitting waveforms indicated by the time-domain electric field strength (for 830 pico seconds) of the antenna apparatus with an antenna interval of 10 mm utilizing the aperture of transmission line used in the simulations of the preferred embodiment with Gaussian pulses.
Figure 24B:
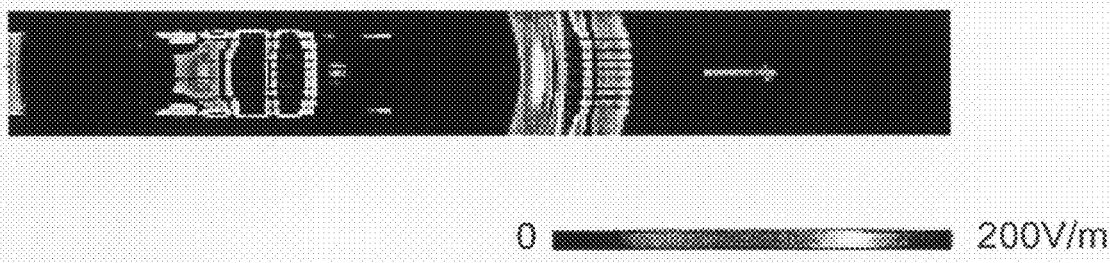
FIG. 24B is a chart showing transmitting waveforms indicated by the time-domain electric field strength (for 830 pico seconds) of the antenna apparatus with an antenna interval of 30 mm utilizing the aperture of transmission line used in the simulations of the preferred embodiment with Gaussian pulses.
Figure 24C:
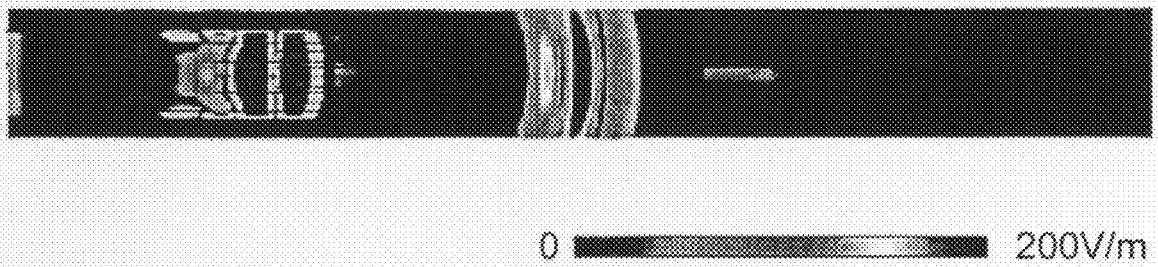
FIG. 24C is a chart showing transmitting waveforms indicated by the time-domain electric field strength (for 830 pico seconds) of the antenna apparatus with an antenna interval of 60 mm utilizing the aperture of transmission line used in the simulations of the preferred embodiment with Gaussian pulses.

FIG. 24A is a chart showing transmitting waveforms indicated by the time-domain electric field strength (for 830 pico seconds) of the antenna apparatus with an antenna interval of 10 mm utilizing the aperture of transmission line used in the simulations of the preferred embodiment with Gaussian pulses, FIG. 24B is a chart showing transmitting waveforms indicated by the time-domain electric field strength (for 830 pico seconds) of the antenna apparatus with an antenna interval of 30 mm, and FIG. 24C is a chart showing transmitting waveforms indicated by the time-domain electric field strength (for 830 pico seconds) of the antenna apparatus with an antenna interval of 60 mm. Namely, FIGS. 24A to 24C shows transmitting waveforms indicated by the time-domain electric field strength in a range to 200 V/m (for 830 pico seconds) of the antenna apparatus utilizing the aperture of transmission line used in the simulations of the preferred embodiment with Gaussian pulses.

Figure 25A:
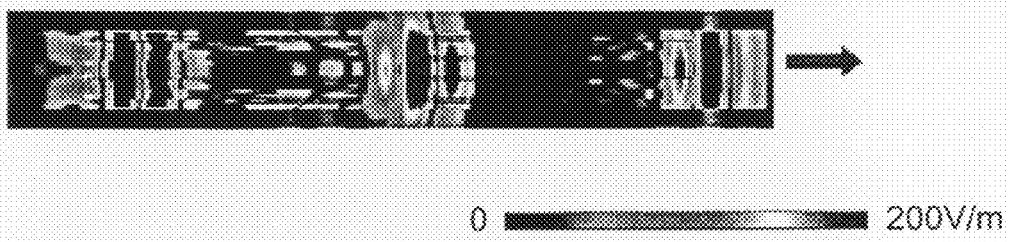
FIG. 25A is a chart showing transmitting waveforms indicated by the time-domain electric field strength (for 1050 pico seconds) of the antenna apparatus with an antenna interval of 10 mm utilizing the aperture of transmission line used in the simulations of the preferred embodiment with Gaussian pulses.
Figure 25B:
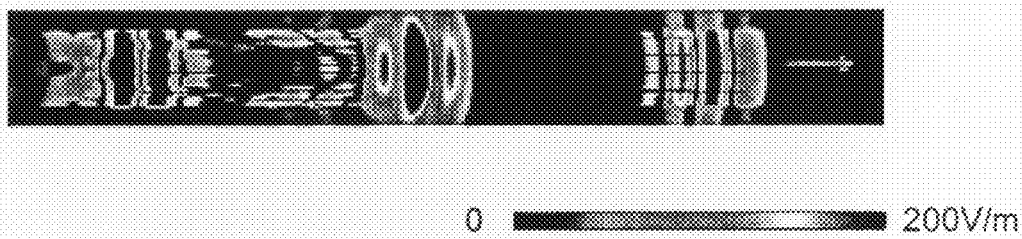
FIG. 25B is a chart showing transmitting waveforms indicated by the time-domain electric field strength (for 1050 pico seconds) of the antenna apparatus with an antenna interval of 30 mm utilizing the aperture of transmission line used in the simulations of the preferred embodiment with Gaussian pulses.
Figure 25C:
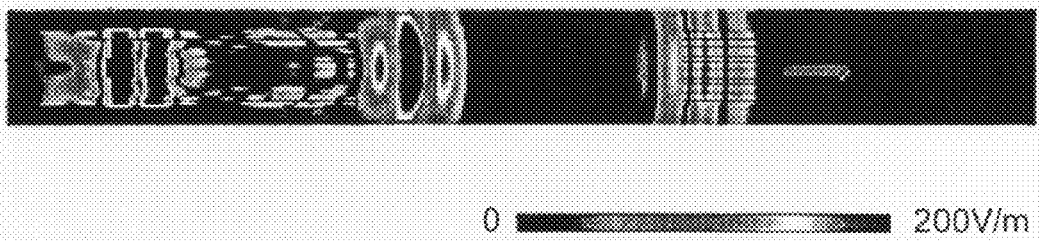
FIG. 25C is a chart showing transmitting waveforms indicated by the time-domain electric field strength (for 1050 pico seconds) of the antenna apparatus with an antenna interval of 60 mm utilizing the aperture of transmission line used in the simulations of the preferred embodiment with Gaussian pulses.

FIG. 25A is a chart showing transmitting waveforms indicated by the time-domain electric field strength (for 1050 pico seconds) of the antenna apparatus with an antenna interval of 10 mm utilizing the aperture of transmission line used in the simulations of the preferred embodiment with Gaussian pulses, FIG. 25B is a chart showing transmitting waveforms indicated by the time-domain electric field strength (for 1050 pico seconds) of the antenna apparatus with an antenna interval of 30 mm, and FIG. 25C is a chart showing transmitting waveforms indicated by the time-domain electric field strength (for 1050 pico seconds) of the antenna apparatus with an antenna interval of 60 mm.

In FIGS. 24A to 24C and 25A to 25C, the transmitting characteristics of the antenna apparatus utilizing the aperture of transmission line of d=32 mm and w=80 mm are expressed by electric field energies.

Figure 26A:
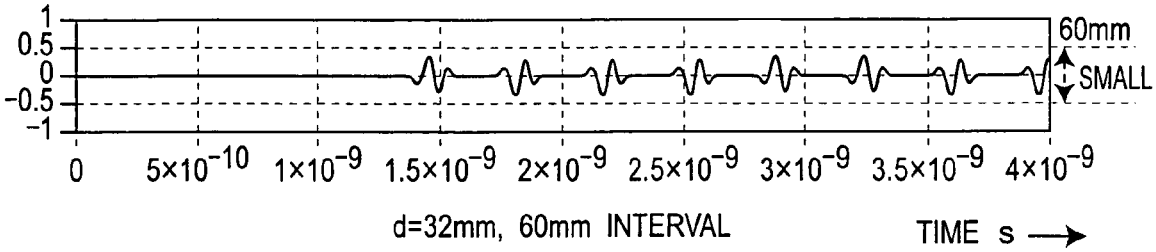
FIG. 26A is a signal waveform chart of the antenna apparatus with an antenna interval of 60 mm for showing differences when the antenna interval is changed as shown in FIGS. 23A to 23D.
Figure 26B:
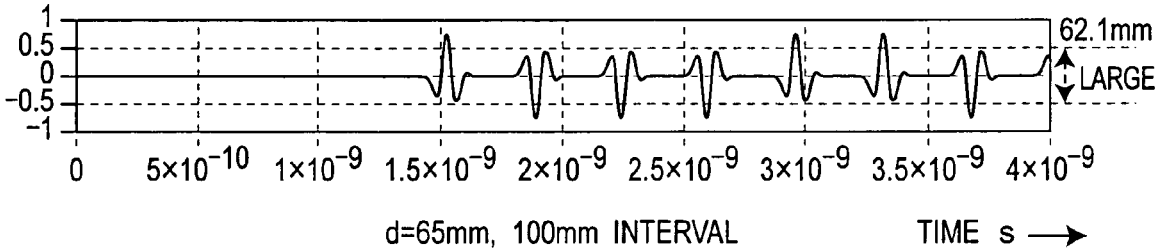
FIG. 26B is a signal waveform chart of the antenna apparatus with an antenna interval of 100 mm for showing differences when the antenna interval is changed as shown in FIGS. 23A to 23D.

FIG. 26A is a signal waveform chart of the antenna apparatus with an antenna interval of 60 mm for showing differences when the antenna interval is changed as shown in FIGS. 23A to 23D, and FIG. 26B is a signal waveform chart of the antenna apparatus with an antenna interval of 100 mm for showing the same differences. As is apparent from FIGS. 26A and 26B, if the receiving characteristics with respect to the aperture plane of d=65 mm are compared with each other, the characteristic that is better than when d=32 mm is obtained in spite of separation by 100 mm. This means that the relation of $(1/4)\lambda g \leqq d$ can be confirmed by the signal transmission simulations. It was discovered from FIGS. 23A to 23D that the antenna apparatus utilizing the aperture of transmission line was able to achieve almost same efficiencies in transmitting and receiving.

Figure 27A:
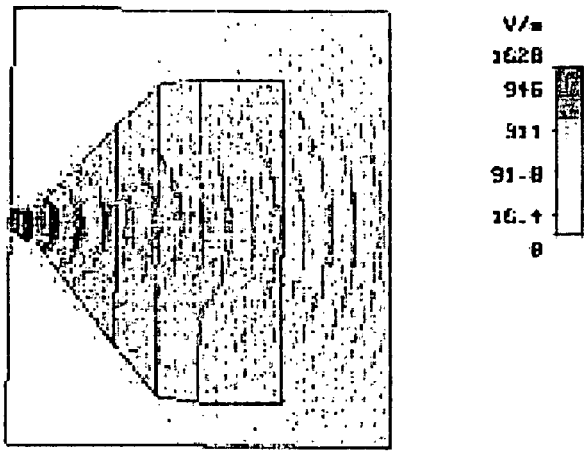
FIG. 27A is a chart showing a top view of a tapered expanded field distribution when the characteristic impedance is made constant in the antenna apparatus utilizing the aperture of transmission line used in the simulations of the present preferred embodiment.
Figure 27B:
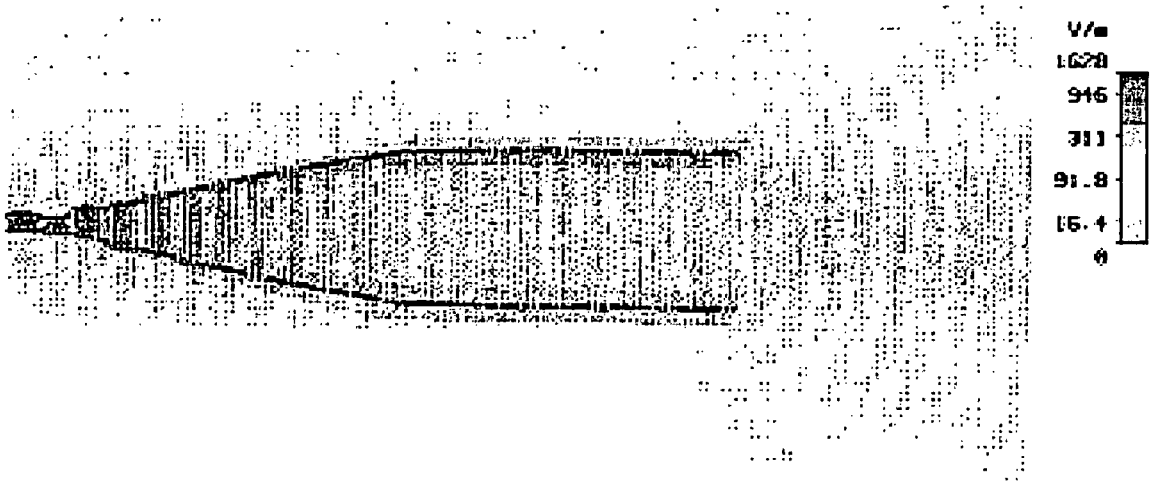
FIG. 27B is a chart showing a side view of a tapered expanded field distribution when the characteristic impedance is made constant in the antenna apparatus utilizing the aperture of transmission line used in the simulations of the present preferred embodiment.

FIG. 27A is a chart showing a top view of a tapered expanded field distribution when the characteristic impedance is made constant in the antenna apparatus utilizing the aperture of transmission line used in the simulations of the present preferred embodiment, and FIG. 27B is a chart showing a side view thereof, where the electric field strength is in a range to 1628 V/m. Namely, FIGS. 27A and 27B show transmitting states of electromagnetic waves of 10-GHz sinusoidal waves when a taper angle θ of 120 degrees is added with the characteristic impedance $Z_0$ maintained or kept to be constant. The dispersion in the state of a circular arc originating at the expansion starting point is found out. The aperture portion 3 cannot perform TEM wave transmission as an antenna as a consequence of time dispersion due to the circular arc shape. The dispersion angle was about 60 degrees, and it was considered that the taper angle θ (or ϕ), expanding in such a state that the electromagnetic coupling on the transmission line was completely achieved, was 30 degrees, and this was adopted as the feature of the present invention.

Figure 28:
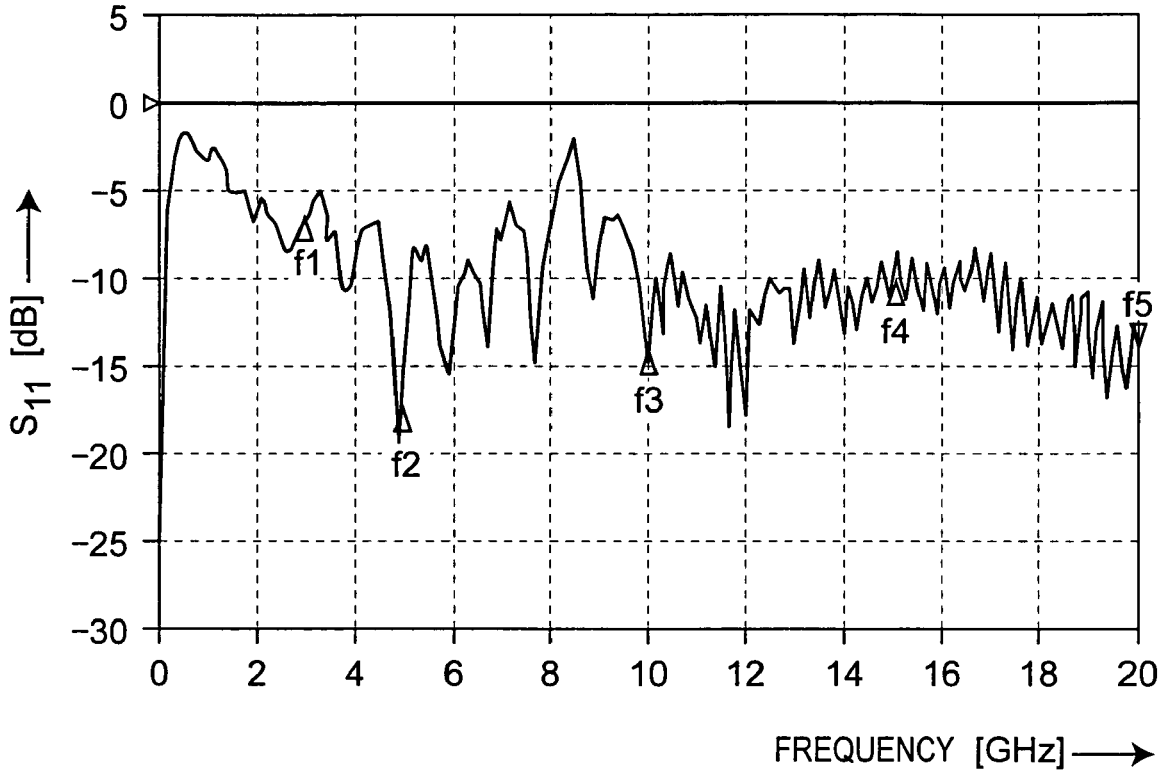
FIG. 28 is a graph showing a frequency characteristic of the reflection coefficient $S_{11}$ of the antenna apparatus utilizing the aperture of transmission line used in the simulations of the present preferred embodiment.

FIG. 28 is a graph showing a frequency characteristic (reference value (horizontal axis located one scale smaller than the upper limit value) in a range from 0.05 GHz to 20 GHz is 0 dB, and one scale represents 5 dB) of the reflection coefficient $S_{11}$ of the antenna apparatus utilizing the aperture of transmission line used in the simulations of the present preferred embodiment. In FIG. 28, f1 denote 3 GHz, f2 denotes 5 GHz, f3 denotes 10 GHz, f4 denotes 15 GHz, and f5 denotes 20 GHz. FIG. 28 is an experimental example, which has such a structure that the expanded tapered line portion 2 is formed of an acrylic plate and floated partway. The specifications of the aperture portion 3 are as follows: d=20 mm, w=30 mm, $(1/4)\lambda$=3.75 GHz. In the present experiment, the stacked pair line 1 is not provided, and the tapered line portion 2 is connected in series with a BNC connector. The characteristic impedance $Z_0$ of the BNC connector is 50Ω, the characteristic impedance $Z_0$ of the tapered line portion 2 formed of the acrylic part is 83.5Ω, and the characteristic impedance $Z_0$ of the aperture portion 3 is 139.4Ω, which constitute such a structure that a large relation attenuation occurs under the conditions far from a constant characteristic impedance. Reviewing the frequency characteristic of the reflection coefficient $S_{11}$ of FIG. 28, such results that are not so bad can be obtained as the radiation characteristics having substantially flat frequency characteristics and that $S_{11}$=approx. −10 dB at frequencies equal to or higher than 3.75 GHz.

Figure 29A:
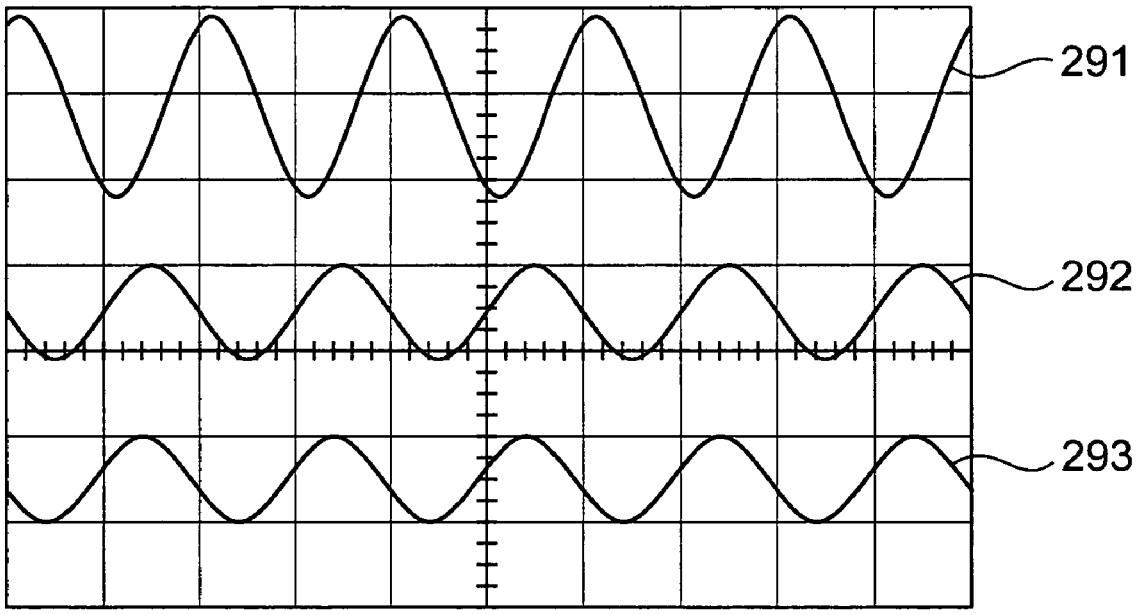
FIG. 29A is a signal waveform chart showing signal waveforms when the distance between aperture planes is changed in a pair of transmission line aperture type antenna apparatuses used in the simulations of the present preferred embodiment.

FIG. 29A is a signal waveform chart showing signal waveforms of 10 GHz when the distance between aperture planes is changed in a pair of transmission line aperture type antenna apparatuses used in the simulations of the present preferred embodiment. In FIG. 29A, 291 denotes a case of a transmission distance of 10 cm and an amplitude of 42.76 mV, 292 denotes a case of a transmission distance of 50 cm and an amplitude of 10.95 mV, and 293 denotes a case of a transmission distance of 100 cm and an amplitude of 10.54 mV.

Figure 29B:
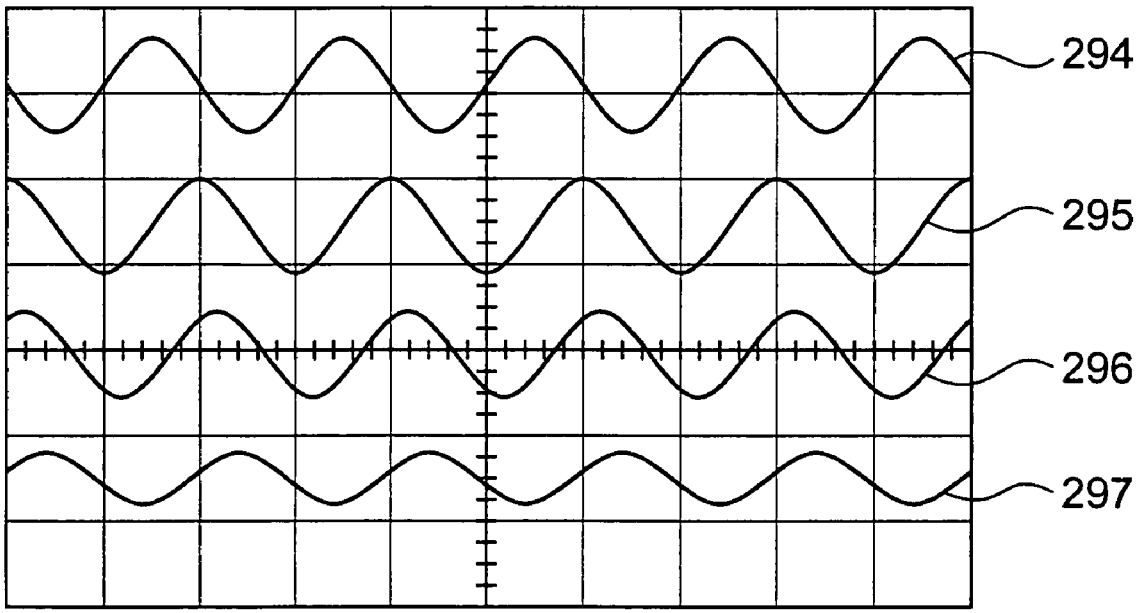
FIG. 29B is a signal waveform chart showing signal waveforms when a displacement distance from the center line is changed in a pair of transmission line aperture type antenna apparatuses used in the simulations of the present preferred embodiment.

FIG. 29B is a signal waveform chart showing signal waveforms at 10 GHz when a displacement distance from the center line is changed in a pair of transmission line aperture type antenna apparatuses used in the simulations of the present preferred embodiment. In FIG. 29B, 294 denotes a case of no displacement and an amplitude of 10.95 mV, 295 denotes a case of 5 cm displacement and an amplitude of 11.72 mV, 296 denotes a case of 10 cm displacement and an amplitude of 9.70 mV, 297 denotes a case of 20 cm displacement and an amplitude of 5.5 mV. Namely, FIGS. 29A and 29B show the transmitting and receiving characteristics when a pair of transmission line aperture type antenna apparatuses having the dimensions of d=20 mm and w=30 mm at the time of input of 10-GHz sine waves (having an amplitude of 1 V) are put in a mutually opposed state. FIG. 29A shows 10-GHz sine wave transmitting characteristics (receiving waveforms) when the antenna apparatus utilizing the aperture of transmission lines of FIG. 28 are opposed to each other and used for transmitting and receiving. Since the input voltage to the transmitting antenna apparatus is 1 V, an antenna gain of −40 dB is obtained by transmitting with the antenna apparatus with an antenna interval of 1 m. An advantageous effect similar to that of the simulations can presumably be expected so long as the characteristic impedance $Z_0$ of the antenna is constant. Moreover, FIG. 29B shows receiving characteristics when the central axes of the transmitting and receiving antennas at an antenna interval of 50 cm are shifted in parallel in the width direction of the transmission line, and this leads to that the antenna apparatus has a substantial directivity.

The present inventor and others further conducted simulations of the antenna apparatus utilizing the aperture of transmission lines of the preferred embodiments of FIGS. 2 to 6. As a result, it was confirmed that the passing coefficient $S_{21}$ and the reflection coefficient $S_{11}$ scarcely suffered influences so long as the width was sufficiently small (e.g., a width of 1 μm with respect to d=100 μm) even when the support members 4*a*, 4*b* or 4*c* was provided. Moreover, in FIGS. 4 to 6 where the aperture portion 3 was expanded in the tapered shape, the results of a reduction in the reflection coefficient $S_{11}$, a slight increase in the antenna gain and a consequent increase in the total antenna radiation efficiency were obtained.

INDUSTRIAL APPLICABILITY

As described in detail above, the antenna apparatus utilizing the aperture of transmission line of the present invention is the antenna apparatus, which is connected to the transmission line and has an extremely simple configuration as compared with that of the prior art and a narrow directivity with almost no change in the frequency characteristics, thereby allowing a remarkably large antenna gain to be achieved. Therefore, the communications can be achieved even at a comparatively long distance. The antenna apparatus utilizing the aperture of transmission line of the present invention is applicable to various applications as follows.

(1) It is applicable to transmitting and receiving between IP terminals of global interconnections or wirings on an IC chip.

(2) It is applicable to means for communications between IC chips.

(3) It is applicable to means for communications between LSI packages.

(4) It is applicable to communications between boards.

(5) It is applicable to long-distance communications.

(6) It is applicable to a system in which UWB or digital signals are subject to direct communications without modulation because of almost no frequency characteristic.

(7) It is applicable to distance measurement and shape measurement of reflective objects.

(8) It is applicable to transmitting and receiving for RFID or the like on the base station side.

(9) It is applicable to transmitting with scanning the frequency, transmitting and receiving intended for scanning receiving, and applications intended for reflection receiving by utilizing the narrow directivity.

(10) It is applicable to MEMS communications, communications inside a living body for medical use and satellite communications with gigantic antennas and power transmission because the principle of the characteristic impedance can be expanded and contracted in similitude.

(11) It is applicable to applications having no relation to the allocation of radio frequencies because of the narrow directivity.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An antenna apparatus which is connected to a first transmission line having a predetermined characteristic impedance, the first transmission line including a pair of first planar line conductors electrically separated from each other such that magnetic lines of force are generated surrounding the first planar line conductors and perpendicularly intersect electric lines of force when electromagnetic waves travel on the first transmission line, the antenna apparatus comprising:

a tapered line portion connected to one end of the first transmission line, the tapered line portion including a second transmission line including a pair of second planar line conductors electrically separated from each other such that magnetic lines of force are generated surrounding the second planar line conductors and perpendicularly intersect electric lines of force when electromagnetic waves travel on the second transmission line, the tapered line portion keeping a predetermined characteristic impedance constant and expanding at least one of a width of the second transmission line and an interval in a tapered shape at a predetermined taper angle; and an aperture portion having a radiation aperture connected to one end of the tapered line portion, the aperture portion including a pair of parallel planar line conductors separated from each other, wherein a size of one side of the aperture end plane of the aperture portion is set to be equal to or higher than a quarter wavelength of the minimum operating frequency of the antenna apparatus.

2. The antenna apparatus as claimed in claim 1, further comprising a support member that short-circuits and supports the second transmission line including the pair of second planar line conductors substantially in a center portion in a width direction of the second transmission line of the aperture portion.

3. The antenna apparatus as claimed in claim 1, further comprising a pair of support members that short-circuit and support the second transmission line including the pair of second planar line conductors substantially at both ends in a width direction of the second transmission line of the aperture portion.

4. The antenna apparatus as claimed in claim 1, wherein the aperture portion is constituted by expanding a width of the second transmission line in a tapered shape.

5. The antenna apparatus as claimed in claim 1, wherein a space located between the pair of first planar line conductors of the first transmission line in the tapered line portion is filled with a predetermined dielectric.

6. The antenna apparatus as claimed in claim 1, wherein a space located between the pair of second planar line conductors of the second transmission line in the aperture portion is filled with a predetermined dielectric.

7. The antenna apparatus as claimed in claim 1, further comprising a support member for supporting both end portions in a width direction of the first transmission line in the tapered line portion with interposition of a predetermined interval.

8. The antenna apparatus as claimed in claim 1, further comprising a support member for supporting both end portions in the width direction of the second transmission line in the aperture portion with interposition of a predetermined interval.

9. The antenna apparatus as claimed in claim 1, wherein the taper angle is set to a predetermined value which is larger than zero degree and equal to or smaller than 30 degrees.

10. The antenna apparatus as claimed in claim 1, wherein the characteristic impedance is set to a predetermined value that is set within a range from 50Ω to 100Ω.

* * * * *